US009784031B2

(12) United States Patent
Volin

(10) Patent No.: US 9,784,031 B2
(45) Date of Patent: Oct. 10, 2017

(54) ADJUSTABLE GATE, HAVING MULTIPLE GUTTERING SYSTEMS, MULTIPLE IMPACT-ABSORBING SYSTEMS, MULTIPLE ANTI-WARPING SYSTEMS, MULTIPLE ANTI-SAGGING SYSTEMS, MULTIPLE PERSONAL-INJURY-ELIMINATING SYSTEMS, AND SELF-CENTERING ANGLE-LOCKING SAFETY TRUSS

(71) Applicant: Dee Volin, Fairview, OR (US)

(72) Inventor: Dee Volin, Fairview, OR (US)

( * ) Notice: Subject to any disclaimer, the term of this patent is extended or adjusted under 35 U.S.C. 154(b) by 177 days.

(21) Appl. No.: 14/882,380

(22) Filed: Oct. 13, 2015

(65) Prior Publication Data

US 2016/0108668 A1 Apr. 21, 2016

Related U.S. Application Data

(60) Provisional application No. 62/064,850, filed on Oct. 16, 2014.

(51) Int. Cl.
*E06B 11/02* (2006.01)
*E06B 7/14* (2006.01)

(52) U.S. Cl.
CPC ..... *E06B 11/02* (2013.01); *E06B 7/14* (2013.01)

(58) Field of Classification Search
CPC ..... E06B 7/14; E06B 11/02
USPC ..... 256/73
See application file for complete search history.

(56) References Cited

U.S. PATENT DOCUMENTS

| | | | | |
|---|---|---|---|---|
| 96,783 | A | 11/1869 | Davis | |
| 524,040 | A | 8/1894 | Godwin | |
| 758,559 | A | 4/1904 | Oppenheim | |
| 851,936 | A | 4/1907 | Hendrich | |
| 1,298,072 | A | 3/1919 | McNabney | |
| 3,037,593 | A | 6/1962 | Webster | |
| 3,290,014 | A | 12/1966 | Stapleton | |
| 3,304,656 | A | 2/1967 | Dvorak | |
| 3,395,489 | A | 8/1968 | Banse | |
| 3,770,245 | A | 11/1973 | Murdock | |
| 4,628,635 | A | 12/1986 | Maillard | |
| 4,722,514 | A * | 2/1988 | Pettit | E04H 17/1421 256/19 |
| 4,793,098 | A | 12/1988 | Wilkerson | |
| 4,809,955 | A | 3/1989 | Veilleux | |
| 4,813,182 | A | 3/1989 | Daniels | |

(Continued)

*Primary Examiner* — Joshua Kennedy

(57) ABSTRACT

A unique adjustable guttering anti-warping anti-sagging safety-truss gate comprises corner gutters to drain rain water, body gutters to drain rain water, extension tubes having multiple built-in tunnel systems to drain rain water, struts having multiple built-in tunnel systems to drain rain water, and vertical tubes having multiple built-in draining-hole systems to drain rain water down to the ground. Further, the unique gate comprises multiple ridge systems built into the extension tubes to strengthen the unique gate, and multiple spring systems built into the vertical tubes to strengthen the unique gate and to absorb impact forces, warping forces, twisting forces, and sagging forces exerted on the unique gate during its lifespan. The corner gutters, body gutters, and vertical tubes are welded to one another to create the frame of the unique gate. The extension tubes are inserted into the body gutters, and the struts are screwed in the corner gutters and on the extension tubes to define the width of the unique gate.

20 Claims, 22 Drawing Sheets

(56) References Cited

U.S. PATENT DOCUMENTS

| | | | | |
|---|---|---|---|---|
| 5,437,134 | A | 8/1995 | Donnelly | |
| 5,457,914 | A | 10/1995 | Johnson, Jr. | |
| 5,664,371 | A | 9/1997 | Berliner | |
| 5,702,090 | A | 12/1997 | Edgman | |
| 5,716,041 | A | 2/1998 | Groves | |
| 5,868,382 | A | 2/1999 | Groves | |
| 6,152,428 | A | 11/2000 | Simioni | |
| 6,176,043 | B1 | 1/2001 | Gibbs | |
| 6,446,938 | B1 | 9/2002 | Hadfield, Sr. | |
| 6,464,209 | B2 | 10/2002 | Meis | |
| 6,491,286 | B1 | 12/2002 | Hadfield, Sr. | |
| 6,561,493 | B1 | 5/2003 | Lackey, Jr. | |
| 6,637,728 | B2 | 10/2003 | Pettit | |
| 6,751,906 | B2 | 6/2004 | Bass | |
| 6,938,882 | B2 | 9/2005 | Hadfield, Sr. | |
| 7,114,706 | B1 | 10/2006 | Bemis | |
| 7,503,550 | B2 | 3/2009 | Liefke | |
| 7,744,065 | B2 | 6/2010 | Terrels | |
| 7,934,699 | B2 | 5/2011 | Zell | |
| 8,132,791 | B2 | 3/2012 | Stucker | |
| 8,341,886 | B2 | 1/2013 | Yates | |
| 8,596,619 | B2 * | 12/2013 | Volin | E04H 17/163 256/73 |
| D698,505 | S | 1/2014 | Muzaffer | |
| 8,713,853 | B2 | 5/2014 | Toro | |
| D710,556 | S | 8/2014 | Muzaffer | |
| 8,870,163 | B2 * | 10/2014 | Regan | E04F 11/181 248/534 |
| 9,458,667 | B2 * | 10/2016 | Bugh | E06B 11/02 |
| 2004/0051092 | A1 | 3/2004 | Curatolo | |
| 2008/0179581 | A1 | 7/2008 | Mulgrew | |
| 2011/0308160 | A1 | 12/2011 | Boucquey | |
| 2012/0324792 | A1 | 12/2012 | Bertsch | |
| 2014/0312290 | A1 * | 10/2014 | Nordlinger | E04H 17/1408 256/24 |
| 2015/0041743 | A1 * | 2/2015 | Richison | E04H 17/166 256/24 |

* cited by examiner

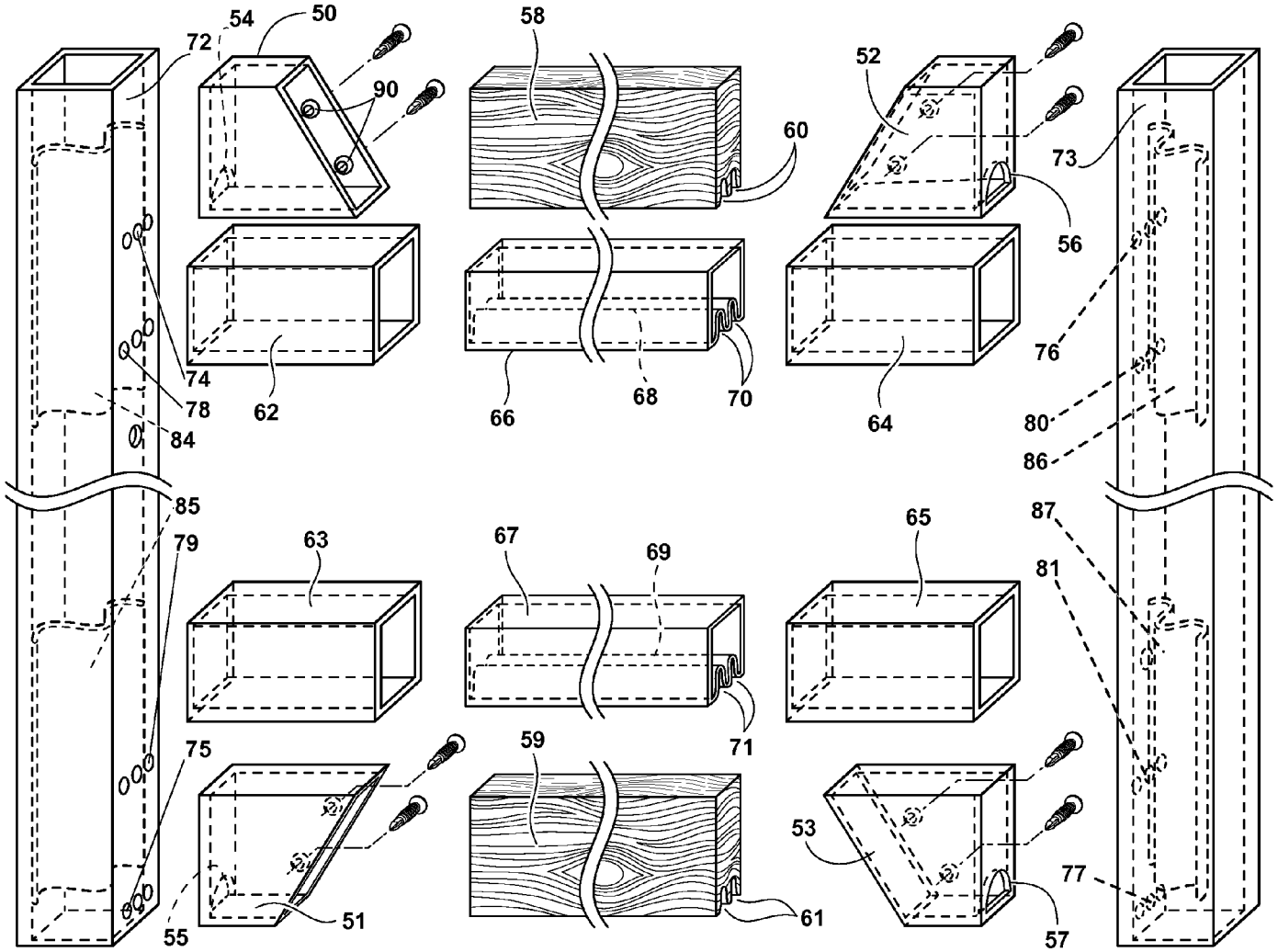
FIG. 3A (front view)

FIG. 3B (front view)
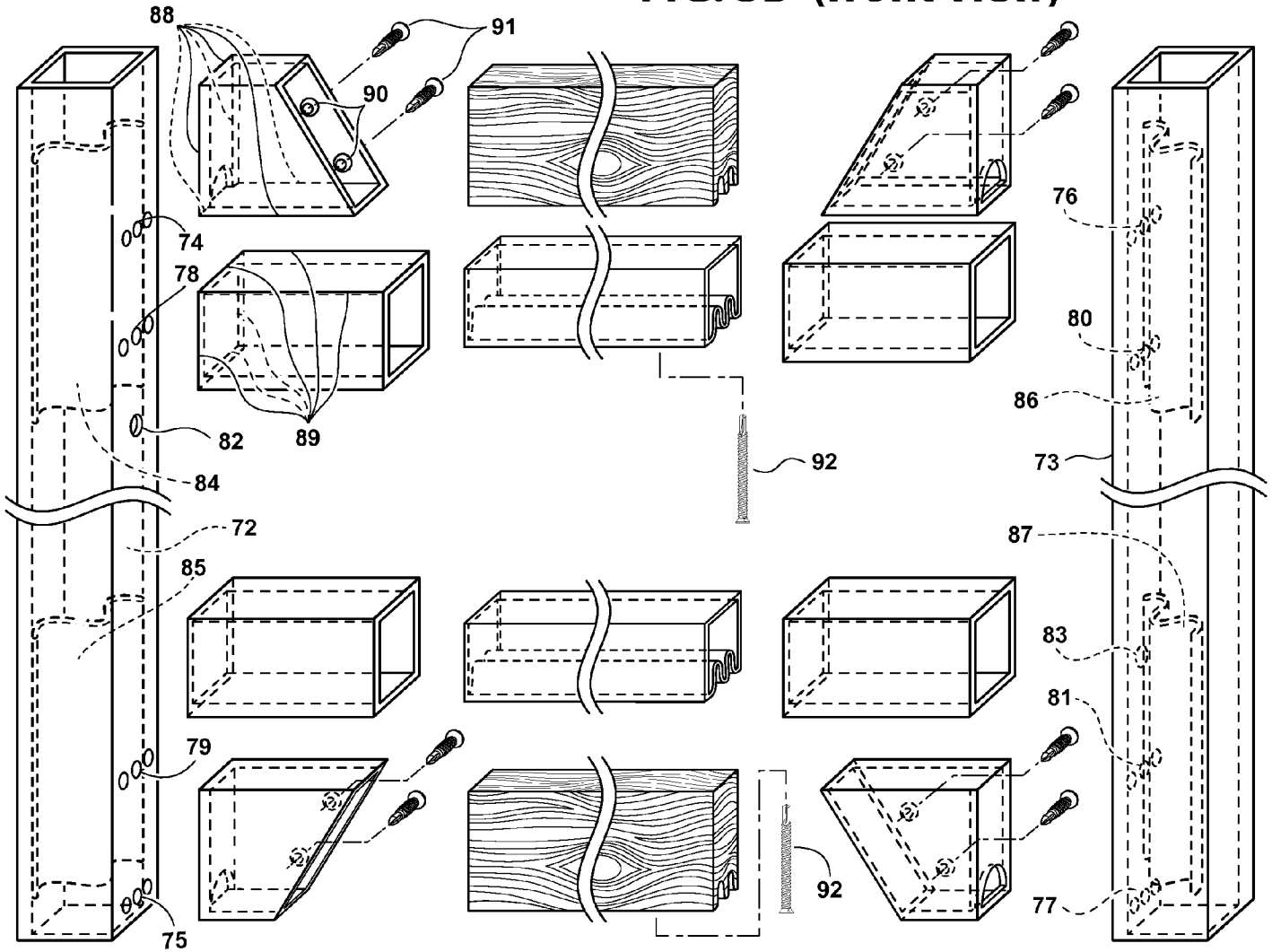

ADJUSTABLE GATE, HAVING MULTIPLE GUTTERING SYSTEMS, MULTIPLE IMPACT-ABSORBING SYSTEMS, MULTIPLE ANTI-WARPING SYSTEMS, MULTIPLE ANTI-SAGGING SYSTEMS, MULTIPLE PERSONAL-INJURY-ELIMINATING SYSTEMS, AND SELF-CENTERING ANGLE-LOCKING SAFETY TRUSS

REFERENCE TO PREVIOUSLY FILED PROVISIONAL PATENT APPLICATION

Provisional Patent Application No. 62/064,850 was filed on Oct. 16, 2014.

FIELD OF THE INVENTION

The present invention relates to a unique adjustable guttering anti-warping anti-sagging safety-truss gate, which can discharge rain water trapped therein during its lifespan, can absorb impact forces exerted thereon during its lifespan, can absorb warping forces exerted thereon during its lifespan, can absorb sagging forces exerted thereon during its lifespan, can hide all screw heads therein to eliminate personal injuries, and can hide the clamp and cable ends of its truss inside its tube to further eliminate personal injuries. Particularly, the present invention relates to a unique adjustable guttering anti-warping anti-sagging safety-truss gate, having:

multiple guttering systems,
multiple impact-absorbing systems,
multiple anti-warping systems,
multiple anti-sagging systems,
multiple personal-injury-eliminating systems, and
self-centering angle-locking safety truss,

DESCRIPTION OF THE PRIOR ART

A number of gates have been introduced.

U.S. Pat. No. 0,096,783, patented 1869 Nov. 16, to J. R. Davis;

U.S. Pat. No. 0,524,040, patented 1894 Aug. 7, to L. R. Godwin;

U.S. Pat. No. 0,758,559, patented 1904 Apr. 26, to P. Oppenheim;

U.S. Pat. No. 0,851,936, patented 1907 Apr. 30, to A. Hendrich;

U.S. Pat. No. 1,298,072, patented 1919 Mar. 25, to J. R. McNabney;

U.S. Pat. No. 3,037,593, patented 1962 Jun. 5, to C. L. Webster;

U.S. Pat. No. 3,290,014, patented 1966 Dec. 6, to M. H. Stapleton;

U.S. Pat. No. 3,304,656, patented 1967 Feb. 21, to W. C. Dvorak;

U.S. Pat. No. 3,395,489, patented 1968 Aug. 6, to G. Banse;

U.S. Pat. No. 3,770,245, patented 1973 Nov. 6, to Robert H. Murdock;

U.S. Pat. No. 4,628,635, patented 1986 Dec. 16, to Susan Maillard;

U.S. Pat. No. 4,793,098, patented 1988 Dec. 27, to Destre L. Wilkerson;

U.S. Pat. No. 4,809,955, patented 1989 Mar. 7, to Clement Veilleux;

U.S. Pat. No. 4,813,182, patented 1989 Mar. 21, to Kurt Daniels;

U.S. Pat. No. 5,437,134, patented 1995 Aug. 1, to Francis M. Donnelly;

U.S. Pat. No. 5,457,914, patented 1995 Oct. 17, to Marvin B. Johnson, Jr.;

U.S. Pat. No. 5,664,371, patented 1997 Sep. 9, to Allen Jay Berliner;

U.S. Pat. No. 5,702,090, patented 1997 Dec. 30, to Thomas J. Edgman;

U.S. Pat. No. 5,716,041, patented 1998 Feb. 10, to Michael F. Groves;

U.S. Pat. No. 5,868,382, patented 1999 Feb. 9, to Michael F. Groves;

U.S. Pat. No. 6,152,428, patented 2000 Nov. 28, to Lino Simioni;

U.S. Pat. No. 6,176,043, patented 2001 Jan. 23, to Edward L. Gibbs;

U.S. Pat. No. 6,446,938, patented 2002 Sep. 10, to John L. Hadfield, Sr.;

U.S. Pat. No. 6,464,209, patented 2002 Oct. 15, to William J. Meis;

U.S. Pat. No. 6,491,286, patented 2002 Dec. 10, to John L. Hadfield, Sr.;

U.S. Pat. No. 6,561,493, patented 2003 May 13, to Joe Lackey, Jr.;

U.S. Pat. No. 6,637,728, patented 2003 Oct. 28, to Fredrick M. Pettit;

U.S. Pat. No. 6,751,906, patented 2004 Jun. 22, to Donnie E. Bass;

U.S. Pat. No. 6,938,882, patented 2005 Sep. 6, to John L. Hadfield, Sr.;

U.S. Pat. No. 7,114,706, patented 2006 Oct. 3, to Jeff Bemis;

U.S. Pat. No. 7,503,550, patented 2009 Mar. 17, to Norman William Liefke;

U.S. Pat. No. 7,744,065, patented 2010 Jun. 29, to Christopher J. Terrels;

U.S. Pat. No. 7,934,699, patented 2011 May 3, to William R. Zell;

U.S. Pat. No. 8,132,791, patented 2012 Mar. 13, to Justin D. Stucker;

U.S. Pat. No. 8,341,886, patented 2013 Jan. 1, to Adam Yates;

U.S. Pat. No. 8,713,853, patented 2014 May 6, to Joseph Toro;

U.S. Pat. No. D698,505, patented 2014 Jan. 28, to Samir Ali Muzaffer;

U.S. Pat. No. D710,556, patented 2014 Aug. 5, to Samir Ali Muzaffer;

U.S. Pub. No. 20040051092, patented 2004 Mar. 18, to Tony Curatolo;

U.S. Pub. No. 20080179581, patented 2008 Jul. 31, to Paul Mulgrew;

U.S. Pub. No. 20110308160, patented 2011 Dec. 22, to Sebastien Boucquey; and

U.S. Pub. No. 20120324792, patented 2012 Dec. 27, to Michel Bertsch disclose a variety of inventions related to gates.

MULTIPLE DISADVANTAGES OF THE PRIOR ART

Referring to FIGS. 1 (PRIOR ART) and 2 (PRIOR ART), the prior art has failed to solve many problems associated with such gates, as follows:

1) No prior art offer or disclose any gates, having multiple upper and lower body-gutters.

Therefore, the prior art of gates:

a) Cannot discharge rain water 38*a* and 38*b* trapped inside upper and lower tubes 39*a* and 39*b* when the prior-art gates sag in the direction of arrow 40,
to prevent them from rusting and growing mold
(FIG. 1 (PRIOR ART); and b) Cannot discharge rain water 38*c* and 38*d* trapped inside upper and lower tubes 39*c* and 39*d* when the prior-art gates sag in the direction of arrow 41,
to prevent them from rusting and growing mold
(FIG. 1 (PRIOR ART).

Therefore, the prior-art of upper and lower tubes 39*a*, 39*b*, 39*c*, and 39*d:* a) Detrimentally rust caused by trapped water in upper and lower tubes 39*a*, 39*b*, 39*c*, and 39*d;* b) Detrimentally grow mold caused by trapped water in upper and lower tubes 39*a*, 39*b*, 39*c*, and 39*d*; and c) Detrimentally cause personal injuries and health issues for those, who clean, work on, and operate the prior-art gates.

2) No prior art offer or disclose any gates, having multiple upper and lower drain-hole systems.
Therefore, the prior art of gates:

a) Cannot discharge rain water 38*a* and 38*b* trapped inside upper and lower extension tubes 42*a* and 42*b* when the prior-art gates sag in the directions of arrow 40,
to prevent them from rusting and growing mold
(FIG. 1 (PRIOR ART); and b) Cannot discharge rain water 38*c* and 38*d* trapped inside upper and lower extension tubes 42*a* and 42*b* when the prior-art gates sag in the directions of arrow 41,
to prevent them from rusting and growing mold
(FIG. 1 (PRIOR ART).

Therefore, upper and lower extension tubes 42*a* and 42*b* of the prior-art gates:

a) Detrimentally rust caused by water 38*a*, 38*b*, 38*c*, and 38*d* trapped in upper and lower tubes 42*a*, 42*b*, 42*c*, and 42*d;* b) Detrimentally grow mold caused by water 38*a*, 38*b*, 38*c*, and 38*d* trapped in upper and lower tubes 42*a*, 42*b*, 42*c*, and 42*d*; and c) Detrimentally cause personal injuries and health issues for those, who clean, work on, and operate the prior-art gates.

3) No prior art offer or disclose any gates, having multiple upper and lower corner-gutters.
Therefore, the prior art of gates:

a) Cannot discharge rain water 43*a* and 43*b* trapped inside corner-brackets 44*a* and 44*b* of the prior-art gates,
to prevent them from rusting and growing mold
(FIG. 2 (PRIOR ART); and b) Cannot discharge rain water 43*c* and 43*d* trapped inside corner-brackets 44*c* and 44*d* of the prior-art gates,
to prevent them from rusting and growing mold
(FIG. 2 (PRIOR ART).

Therefore, corner-brackets 44*a*, 44*b*, 44*c*, and 44*d* of the prior-art gates:

a) Detrimentally rust caused by water 43*a*, 43*b*, 43*c*, and 43*d* trapped in corner-brackets 44*a*, 44*b*, 44*c*, and 44*d;* b) Detrimentally grow mold caused by water 43*a*, 43*b*, 43*c*, and 43*d* trapped in corner-brackets 44*a*, 44*b*, 44*c*, and 44*d*; and c) Detrimentally cause personal injuries and health issues for those, who clean, work on, and operate the prior-art gates.

4) No prior art offer or disclose any gates, having multiple additional upper and lower drain-hole systems.
Therefore, the prior art of gates:

a) Cannot discharge rain water 43*a* and 43*b* trapped between upper and lower horizontal struts 45*a* and 45*b* and upper and lower tubes 39*a* and 39*b* of the prior-art gates,
to prevent them from rotting, rusting, and growing mold
(FIGS. 1 (PRIOR ART) and 2 (PRIOR ART); and b) Cannot discharge rain water 43*a* and 43*b* trapped between upper and lower horizontal struts 45*a* and 45*b* and upper and lower tubes 39*c* and 39*d* of the prior-art gates,
to prevent them from rotting, rusting, and growing mold
(FIGS. 1 (PRIOR ART) and 2 (PRIOR ART).

Therefore, upper and lower horizontal struts 45*a* and 45*b* of the prior-art gates:

a) Detrimentally rust from the damage of water 43*a* and 43*b* to upper and lower horizontal struts 45*a* and 45*b* and upper and lower tubes 39*a* and 39*b* of the adjustable prior-art gates;

b) Detrimentally grow mold from the damage of water 43*a* and 43*b* to upper and lower horizontal struts 45*a* and 45*b* and upper and lower tubes 39*a* and 39*b* of the adjustable prior-art gates; and c) Detrimentally cause personal injuries and health issues for those, who clean, work on, and operate the prior-art gates.

5) No prior art offer or disclose any gates, having multiple upper and lower impact-absorbing anti-warping systems.
Therefore, the prior art of gates:

a) Cannot absorb the slamming forces exerted on the prior-art gates during its lifespan,
to prevent the prior-art gates from twisting
(FIG. 2 (PRIOR ART); and b) Cannot absorb the warping forces exerted on the prior-art gates during its lifespan,
to prevent the prior-art gates from warping
(FIG. 2 (PRIOR ART).

Therefore, the prior-art of gates:

a) Detrimentally bend and warp, which shortens their lifespan;

b) Detrimentally become out of alignment with the fence, which shortens their lifespan; and c) Detrimentally become unattractive.

6) No prior art offer or disclose any gates, having multiple upper and lower anti-sagging systems.
Therefore, the prior art of gates:

a) Cannot counteract gravitational forces 46*a* and 46*b* exerted on upper extension tube 47*a* of the prior-art gates,
to prevent the prior-art gates from bending and sagging
(FIG. 2 (PRIOR ART); and b) Cannot counteract gravitational forces 46*a* and 46*b* exerted on lower extension tube 47*b* of the prior-art gates,
to prevent the prior-art gates from bending and sagging
(FIG. 2 (PRIOR ART).

Therefore, the prior art of upper and lower extension tubes 47*a* and 47*b:* a) Detrimentally bend and sag, which shortens their lifespan;

b) Detrimentally become out of alignment with the fence, which shortens their lifespan; and c) Detrimentally become unattractive.

7) No prior art offer or disclose any gates, having multiple personal-injury-eliminating systems.
Therefore, the prior art of gates:

a) Cannot hide all exposed, rusting, and hazardous screw heads 48*a*, 48*b*, 48*c*, and 48*d* of the prior-art gates,
to prevent them from scratching, poking, cutting, and causing personal injuries and health issues for those, who clean, work on, and operate the prior-art gates (FIG. 1 (PRIOR ART); and b) Cannot hide all exposed, rusting, and hazardous screw heads 48*e* and 48*f* of the prior-art gates,
to prevent them from scratching, poking, cutting, and causing personal injuries and health issues for those, who clean, work on, and operate the prior-art gates (FIG. 1 (PRIOR ART).

Therefore, all exposed, rusting, and hazardous screw heads 48*a*, 48*b*, 48*c*, 48*d*, 48*e*, and 48*f* of the prior-art gates:

a) Detrimentally scratch;
b) Detrimentally poke;
c) Detrimentally cut; and
d) Detrimentally cause personal injuries and health issues for those, who clean, work on, and operate the prior-art gates.

8) No prior art offer or disclose any gates, having self-centering angle-locking safety truss.
Therefore, the prior art of gates:

a) Cannot hide its self-centering angle-locking truss-cable-end clamp inside one of the vertical tubes of the prior-art gates,
to prevent them from scratching, poking, cutting, and causing personal injuries and health issues for those, who clean, work on, and operate the prior-art gates (FIGS. 11 and 15); and b) Cannot hide both of its rusting and hazardous cable ends inside one of the vertical tubes of the prior-art gates,
to prevent them from scratching, poking, cutting, and causing personal injuries and health issues for those, who clean, work on, and operate the prior-art gates (FIGS. 11 and 15).

Therefore, both of exposed, rusting, and hazardous cable ends 49*a* and 49*b* of the truss of the prior-art gates (FIG. 2 (PRIOR ART):

a) Detrimentally scratch;
b) Detrimentally poke;
c) Detrimentally cut; and
d) Detrimentally cause personal injuries and health issues for those, who clean, work on, and operate the prior-art gates.

9) No prior art offer or disclose any gates, having multiple upper- and lower-extension-tube ridges.
Therefore, the prior art of gates:

a) Cannot absorb the slamming forces exerted on the prior-art gates during their lifespan,
to prevent the prior-art gates from twisting and warping, which shortens their lifespan (FIGS. 3A, 8, and 9); and b) Cannot absorb the warping forces exerted on the prior-art gates during their lifespan,
to prevent the prior-art gates from twisting and warping, which shortens their lifespan (FIGS. 3A, 8, and 9).

Therefore, the prior art of gates:

a) Detrimentally, further, bend, sag, twist, and turn themselves out of their original shape;
b) Detrimentally, further, bend, sag, twist, and turn themselves out of their alignment with the fence;
c) Detrimentally, further, bend, sag, twist, and turn themselves out of their original attractive appearance;
d) Detrimentally, further, bending, sagging, twisting and turning, thereby shortening their lifespan; and
e) Are more expensive, due to their shorter lifespan.

10) No prior art offer or disclose any gates, having multiple upper- and lower-extension-tube ridges.
Therefore, the prior art of gates:

a) Cannot generate counteracting forces 120*a* (FIG. 14), which counteract gravitational forces 46*a* and 46*b* exerted on the prior-art gates during their lifespan,
to prevent the prior-art gates from bending and sagging, which shortens their lifespan (FIG. 2 (PRIOR ART); and b) Cannot generate counteracting forces 120*b* (FIG. 14), which counteract gravitational forces 46*a* and 46*b* exerted on the prior-art gates during their lifespan,
to prevent the prior-art gates from bending and sagging, which shortens their lifespan (FIG. 2 (PRIOR ART).

Therefore, the prior art of upper and lower extension tubes 47*a* and 47*b:* a) Detrimentally, further, bend, sag, twist, and turn themselves out of their original shape;
b) Detrimentally, further, bend, sag, twist, and turn themselves out of their alignment with the fence;
c) Detrimentally, further, bend, sag, twist, and turn themselves out of their original attractive appearance;
d) Detrimentally, further, bending, sagging, twisting and turning, thereby shortening their lifespan; and
e) Are more expensive, due to their shorter lifespan.

11) No prior art offer or disclose any gates, having upper and lower impact-absorbing anti-warping springs.
Therefore, the prior art of gates:

a) Cannot generate stabilizing spring forces, which counteract impacting and warping forces exerted on the vertical tubes of the prior-art gates,
to prevent the vertical tubes of the prior-art gates from bending, sagging, twisting and turning, which shortens their lifespan; and (FIGS. 12, 13, and 14); and b) Cannot generate stabilizing spring forces, which counteract twisting and turning forces exerted on the vertical tubes of the prior-art gates,
to prevent the vertical tubes from bending, sagging, twisting and turning, which shortens their lifespan (FIGS. 12, 13, and 14).

Therefore, the prior art of gates:

a) Detrimentally, even further, bend, sag, twist, and turn themselves out of their original shape;
b) Detrimentally, even further, bend, sag, twist, and turn themselves out of their alignment with the fence;
c) Detrimentally, even further, bend, sag, twist, and turn themselves out of their original attractive appearance;
d) Detrimentally, even further, bending, sagging, twisting and turning, thereby shortening their lifespan; and
e) Are even more expensive, due to their shorter lifespan.

12) No prior art offer or disclose any gates, having upper and lower impact-absorbing anti-warping springs.
Therefore, the prior art of gates:

a) Cannot generate strengthening spring forces, which counteract impacting and warping forces exerted on the vertical tubes of the prior-art gates,
to add more strength to the vertical tubes of the prior-art gates to prevent them from bending, sagging, twisting and turning, which shortens their lifespan (FIGS. 12, 13, and 14); and b) Cannot generate strengthening spring forces, which counteract twisting and turning forces exerted on the vertical tubes of the prior-art gates,
to add more strength to the vertical tubes of the prior-art gates to prevent them from bending, sagging, twisting and turning, which shortens their lifespan
(FIGS. 12, 13, and 14).

Therefore, the prior art of gates:

a) Detrimentally, even further, bend, sag, twist, and turn themselves out of their original shape;
b) Detrimentally, even further, bend, sag, twist, and turn themselves out of their alignment with the fence;
c) Detrimentally, even further, bend, sag, twist, and turn themselves out of their original attractive appearance;
d) Detrimentally, even further, bending, sagging, twisting and turning, thereby shortening their lifespan; and
e) Are even more expensive, due to their shorter lifespan.

OBJECTS AND ADVANTAGES OF THE INVENTION

The present invention substantially departs from the conventional concepts and designs of the prior art. In doing so, the present invention provides a unique adjustable guttering anti-warping anti-sagging safety-truss gate, having many unique and significant features, functions, and advantages, which overcome all the disadvantages of the prior art, as follows:

1) It is an object of the new invention to provide the unique adjustable guttering anti-warping anti-sagging safety-truss gate, having multiple upper and lower body-gutters.

Therefore, the unique adjustable guttering anti-warping anti-sagging safety-truss gate:

a) Can discharge rain water 38*a* and 38*b* trapped inside upper and lower tubes 39*a* and 39*b* when they sag in the direction of arrow 40,
to prevent them from rusting and growing mold
(FIG. 1 (PRIOR ART); and
b) Can discharge rain water 38*c* and 38*d* trapped inside upper and lower tubes 39*c* and 39*d* when they sag in the direction of arrow 41,
to prevent them from rusting and growing mold
(FIG. 1 (PRIOR ART).

Therefore, the unique adjustable guttering anti-warping anti-sagging safety-truss gate:

a) Can eliminate rust caused by water 38*a*, 38*b*, 38*c*, and 38*d* trapped in upper and lower tubes 39*a*, 39*b*, 39*c*, and 39*d;*
b) Can eliminate mold growth caused by water 38*a*, 38*b*, 38*c*, and 38*d* trapped in upper and lower tubes 39*a*, 39*b*, 39*c*, and 39*d*; and
c) Can eliminate personal injuries and health issues for those, who clean, work on, and operate the adjustable prior-art gates.

2) It is another object of the new invention to provide the unique adjustable guttering anti-warping anti-sagging safety-truss gate, having multiple upper and lower drain-hole systems.

Therefore, the unique adjustable guttering anti-warping anti-sagging safety-truss gate:

a) Can discharge rain water 38*a* and 38*b* trapped inside upper and lower extension tubes 42*a* and 42*b* when they sag in the directions of arrow 40,
to prevent them from rusting and growing mold
(FIG. 1 (PRIOR ART); and
b) Can discharge rain water 38*c* and 38*d* trapped inside upper and lower extension tubes 42*a* and 42*b* when they sag in the directions of arrow 41,
to prevent them from rusting and growing mold
(FIG. 1 (PRIOR ART).

Therefore, the unique adjustable guttering anti-warping anti-sagging safety-truss gate:

a) Can eliminate rust caused by water 38*a*, 38*b*, 38*c*, and 38*d* trapped in upper and lower tubes 42*a*, 42*b*, 42*c*, and 42*d;*
b) Can eliminate mold growth caused by water 38*a*, 38*b*, 38*c*, and 38*d* trapped in upper and lower tubes 42*a*, 42*b*, 42*c*, and 42*d*; and
c) Can eliminate personal injuries and health issues for people, who clean, work on, and operate the adjustable prior-art gates.

3) It is a further object of the new invention to provide the unique adjustable guttering anti-warping anti-sagging safety-truss gate, having multiple upper and lower corner-gutters.

Therefore, the unique adjustable guttering anti-warping anti-sagging safety-truss gate:

a) Can discharge rain water 43*a* and 43*b* trapped inside corner-brackets 44*a* and 44*b* of the adjustable prior-art gates,
to prevent them from rusting and growing mold
(FIG. 2 (PRIOR ART); and
b) Can discharge rain water 43*c* and 43*d* trapped inside corner-brackets 44*c* and 44*d* of the adjustable prior-art gates,
to prevent them from rusting and growing mold
(FIG. 2 (PRIOR ART).

Therefore, the unique adjustable guttering anti-warping anti-sagging safety-truss gate:

a) Can eliminate rust caused by water 43*a*, 43*b*, 43*c*, and 43*d* trapped in corner-brackets 44*a*, 44*b*, 44*c*, and 44*d;*
b) Can eliminate mold growth caused by water 43*a*, 43*b*, 43*c*, and 43*d* trapped in corner-brackets 44*a*, 44*b*, 44*c*, and 44*d*; and
c) Can eliminate personal injuries and health issues for those, who clean, work on, and operate the adjustable prior-art gates.

4) It is an even further object of the new invention to provide the unique adjustable guttering anti-warping anti-sagging safety-truss gate, having multiple additional upper and lower drain-hole systems.

Therefore, the unique adjustable guttering anti-warping anti-sagging safety-truss gate:

a) Can discharge rain water 43*a* and 43*b* trapped between upper and lower horizontal struts 45*a* and 45*b* and upper and lower tubes 39*a* and 39*b* of the adjustable prior-art gates,
to prevent them from rotting, rusting, and growing mold
(FIG. 2 (PRIOR ART); and
b) Can discharge rain water 43*a* and 43*b* trapped between upper and lower horizontal struts 45*a* and 45*b* and upper and lower tubes 39*c* and 39*d* of the adjustable prior-art gates,
to prevent them from rotting, rusting, and growing mold
(FIG. 2 (PRIOR ART).

Therefore, the unique adjustable guttering anti-warping anti-sagging safety-truss gate:

a) Can eliminate rot and rust from the damage of water 43*a* and 43*b* to upper and lower horizontal struts 45*a* and 45*b* and upper and lower tubes 39*a* and 39*b* of the adjustable prior-art gates;

b) Can eliminate mold growth from the damage of water 43*a* and 43*b* to upper and lower horizontal struts 45*a* and 45*b* and upper and lower tubes 39*a* and 39*b* of the adjustable prior-art gates; and c) Can eliminate personal injuries and health issues for those, who clean, work on, and operate the adjustable prior-art gates.

5) It is another object of the new invention to provide the unique adjustable guttering anti-warping anti-sagging safety-truss gate, having multiple upper and lower impact-absorbing anti-warping systems.

Therefore, the unique adjustable guttering anti-warping anti-sagging safety-truss gate:

a) Can absorb the slamming forces exerted thereon during its lifespan,
to prevent itself from twisting
(FIG. 2 (PRIOR ART); and b) Can absorb the warping forces exerted thereon during its lifespan,
to prevent itself from warping
(FIG. 2 (PRIOR ART).

Therefore, the unique adjustable guttering anti-warping anti-sagging safety-truss gate:

a) Can resist twisting and warping, thereby retaining its original shape;

b) Can resist twisting and warping, thereby retaining its alignment with the fence;

c) Can resist twisting and warping, thereby retaining its original attractive appearance;

d) Can resist twisting and warping, thereby extending its lifespan; and e) Can be cost-effective, due to its longer lifespan.

6) It is yet another object of the new invention to provide the unique adjustable guttering anti-warping anti-sagging safety-truss gate, having multiple upper and lower anti-sagging systems.

Therefore, the unique adjustable guttering anti-warping anti-sagging safety-truss gate:

a) Can counteract gravitational forces 46*a* and 46*b* exerted on upper extension tube 47*a* of the adjustable prior-art gates,
to prevent the adjustable prior-art gates from bending and sagging
(FIG. 2 (PRIOR ART); and b) Can counteract gravitational forces 46*a* and 46*b* exerted on lower extension tube 47*b* of the adjustable prior-art gates,
to prevent the adjustable prior-art gates from bending and sagging
(FIG. 2 (PRIOR ART).

Therefore, the unique adjustable guttering anti-warping anti-sagging safety-truss gate:

a) Can resist bending and sagging to upper and lower extension tubes 47*a* and 47*b*, thereby retaining its original shape;

b) Can resist bending and sagging to upper and lower extension tubes 47*a* and 47*b*, thereby retaining its alignment with the fence;

c) Can resist bending and sagging to upper and lower extension tubes 47*a* and 47*b*, thereby retaining its original attractive appearance;

d) Can resist bending and sagging to upper and lower extension tubes 47*a* and 47*b*, thereby extending its lifespan; and e) Can be cost-effective due to its longer lifespan.

7) It is still yet another object of the new invention to provide the unique adjustable guttering anti-warping anti-sagging safety-truss gate, having multiple personal-injury-eliminating systems.

Therefore, the unique adjustable guttering anti-warping anti-sagging safety-truss gate:

a) Can hide all exposed, rusting, and hazardous screw heads 48*a*, 48*b*, 48*c*, and 48*d* of the adjustable prior-art gates,
to prevent them from scratching, poking, cutting, and causing personal injuries and health issues for those, who clean, work on, and operate the adjustable prior-art gates
(FIG. 1 (PRIOR ART); and b) Can hide all exposed, rusting, and hazardous screw heads 48*e* and 48*f* of the prior-art gates,
to prevent them from scratching, poking, cutting, and causing personal injuries and health issues for those, who clean, work on, and operate the adjustable prior-art gates
(FIG. 1 (PRIOR ART).

Therefore, the unique adjustable guttering anti-warping anti-sagging safety-truss gate:

a) Can eliminate scratches caused by exposed, rusting, and hazardous screw heads 48*a*, 48*b*, 48*c*, 48*d*, 48*e*, and 48*f*, b) Can eliminate pokes caused by exposed, rusting, and hazardous screw heads 48*a*, 48*b*, 48*c*, 48*d*, 48*e*, and 48*f*, c) Can eliminate cuts caused by exposed, rusting, and hazardous screw heads 48*a*, 48*b*, 48*c*, 48*d*, 48*e*, and 48*f*, and d) Can eliminate personal injuries and health issues for those, who clean, work on, and operate the adjustable prior-art gates.

8) It is still yet an even further object of the new invention to provide the unique adjustable guttering anti-warping anti-sagging safety-truss gate, having self-centering angle-locking safety truss.

Therefore, the unique adjustable guttering anti-warping anti-sagging safety-truss gate:

a) Can hide its self-centering angle-locking truss-cable-end clamp inside one of the vertical tubes,
to prevent them from scratching, poking, cutting, and causing personal injuries and health issues for those, who clean, work on, and operate the adjustable prior-art gates
(FIGS. 11 and 15); and b) Can hide both of its rusting and hazardous cable ends inside one of the vertical tubes,
to prevent them from scratching, poking, cutting, and causing personal injuries and health issues for those, who clean, work on, and operate the adjustable prior-art gates
(FIGS. 11 and 15).

Therefore, the unique adjustable guttering anti-warping anti-sagging safety-truss gate:

a) Can eliminate scratches caused by exposed, rusting, and hazardous truss-cable-end clamp and truss-cable ends, b) Can eliminate pokes caused by exposed, rusting, and hazardous truss-cable-end clamp and truss-cable ends c) Can eliminate cuts caused by exposed, rusting, and hazardous truss-cable-end clamp and truss-cable ends, and d) Can eliminate personal injuries and health issues for those, who clean, work on, and operate the adjustable prior-art gates.

9) It is still yet an even further object of the new invention to provide the unique adjustable guttering anti-warping anti-sagging safety-truss gate, having multiple upper- and lower-extension-tube ridges.

Therefore, the unique adjustable guttering anti-warping anti-sagging safety-truss gate:

a) Can absorb the slamming forces exerted thereon during their lifespan, to prevent itself from twisting and warping, which shortens its lifespan (FIGS. 3A, 8, and 9); and b) Can absorb the warping forces exerted thereon during its lifespan, to prevent itself from twisting and warping, which extends its lifespan (FIGS. 3A, 8, and 9).

Therefore, the unique adjustable guttering anti-warping anti-sagging safety-truss gate:

a) Can, further, resist twisting and warping, thereby retaining its original shape;

b) Can, further, resist twisting and warping, thereby retaining its alignment with the fence;

c) Can, further, resist twisting and warping, thereby retaining its original attractive appearance;

d) Can, further, resist twisting and warping, thereby extending its lifespan; and e) Can be more cost-effective, due to its longer lifespan.

10) It is still yet an even further object of the new invention to provide the unique adjustable guttering anti-warping anti-sagging safety-truss gate, having multiple upper- and lower-extension-tube ridges.

Therefore, the unique adjustable guttering anti-warping anti-sagging safety-truss gate:

a) Can generate counteracting forces 120*a* (FIG. 14), which counteract gravitational forces 46*a* and 46*b* exerted thereon during its lifespan, to prevent itself from bending and sagging, which extends its lifespan (FIG. 2 (PRIOR ART); and b) Can generate counteracting forces 120*b* (FIG. 14), which counteract gravitational forces 46*a* and 46*b* exerted thereon during its lifespan, to prevent itself from bending and sagging, which extends its lifespan (FIG. 2 (PRIOR ART).

Therefore, the unique adjustable guttering anti-warping anti-sagging safety-truss gate:

a) Can, further, resist bending and sagging, thereby retaining its original shape;

b) Can, further, resist bending and sagging, thereby retaining its alignment with the fence;

c) Can, further, resist bending and sagging, thereby retaining its original attractive appearance;

d) Can, further, resist bending and sagging, thereby extending its lifespan; and e) Can be more cost-effective, due to its longer lifespan.

11) It is yet a further object of the new invention to provide the unique adjustable guttering anti-warping anti-sagging safety-truss gate, having upper and lower impact-absorbing anti-warping springs.

Therefore, the unique adjustable guttering anti-warping anti-sagging safety-truss gate:

a) Can generate stabilizing spring forces 117*a*, 117*b*, 118*a*, 118*b*, 119*a*, and 119*b* (FIG. 13), which counteract impacting and warping forces exerted on vertical tubes 72 and 73, to prevent vertical tubes 72 and 73 from bending, sagging, twisting and turning, which shortens their lifespan; and b) Can generate stabilizing spring forces 117*a*, 117*b*, 118*a*, 118*b*, 119*a*, and 119*b* (FIG. 13), which counteract twisting and turning forces exerted on vertical tubes 72 and 73, to prevent vertical tubes 72 and 73 from bending, sagging, twisting and turning, which shortens their lifespan.

Therefore, the unique adjustable guttering anti-warping anti-sagging safety-truss gate:

a) Can, even further, resist bending, sagging, twisting, and turning, thereby retaining its original shape;

b) Can, even further, resist bending, sagging, twisting, and turning, thereby retaining its alignment with the fence;

c) Can, even further, resist bending, sagging, twisting, and turning, thereby retaining its original attractive appearance;

d) Can, even further, resist bending, sagging, twisting, and turning, thereby extending its lifespan; and e) Can be even more cost-effective, due to its longer lifespan.

12) It is still yet an even further object of the new invention to provide the unique adjustable guttering anti-warping anti-sagging safety-truss gate, having upper and lower impact-absorbing anti-warping springs.

Therefore, the unique adjustable guttering anti-warping anti-sagging safety-truss gate:

a) Can generate strengthening spring forces 117*a*, 117*b*, 118*a*, 118*b*, 119*a*, and 119*b* (FIG. 13), which counteract impacting and warping forces exerted on vertical tubes 72 and 73, to add more strength to vertical tubes 72 and 73 to prevent them from bending, sagging, twisting and turning, which shortens their lifespan; and b) Can generate strengthening spring forces 117*a*, 117*b*, 118*a*, 118*b*, 119*a*, and 119*b* (FIG. 13), which counteract twisting and turning forces exerted on vertical tubes 72 and 73, to add more strength to vertical tubes 72 and 73 to prevent them from bending, sagging, twisting and turning, which shortens their lifespan.

Therefore, the unique adjustable guttering anti-warping anti-sagging safety-truss gate:

a) Can, even further, resist bending, sagging, twisting, and turning, thereby retaining its original shape;

b) Can, even further, resist bending, sagging, twisting, and turning, thereby retaining its alignment with the fence;

c) Can, even further, resist bending, sagging, twisting, and turning, thereby retaining its original attractive appearance;

d) Can, even further, resist bending, sagging, twisting, and turning, thereby extending its lifespan; and e) Can be even more cost-effective, due to its longer lifespan.

Other objects and advantages of the present invention will become apparent from a consideration of the accompanying drawings and ensuing description.

BRIEF DESCRIPTION OF THE DRAWINGS

FIGS. 3A and 3B illustrate front views of a unique adjustable guttering anti-warping anti-sagging safety-truss gate.

SUMMARY OF THE INVENTION

Figure 1:
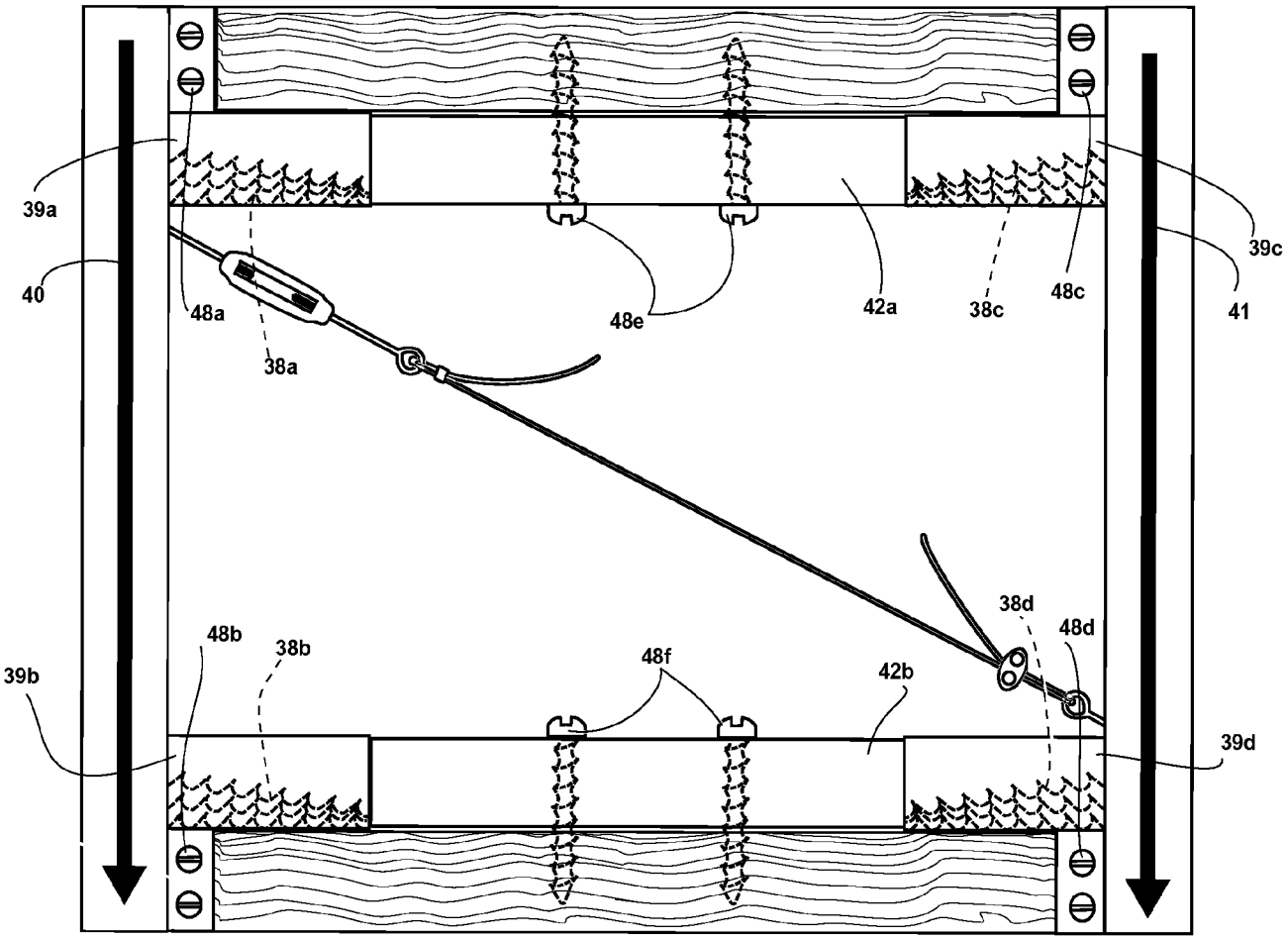
FIG. 1 (PRIOR ART)
FIG. 1 (PRIOR ART) illustrates a front view of a prior-art adjustable gate with many disadvantages of hazardous exposed rusted screw heads and hazardous trapped rain-water pools.

A unique adjustable guttering anti-warping anti-sagging safety-truss gate comprises corner gutters to drain rain water, body gutters to drain rain water, extension tubes having multiple built-in tunnel systems to drain rain water, struts having multiple built-in tunnel systems to drain rain water, and vertical tubes having multiple built-in draining-hole systems to drain rain water down to the ground. Further, the unique gate comprises multiple ridge systems built into the extension tubes to strengthen the unique gate, and multiple spring systems built into the vertical tubes to strengthen the unique gate and to absorb impact forces, warping forces, twisting forces, and sagging forces exerted on the unique gate during its lifespan. The corner gutters, body gutters, and vertical tubes are welded to one another to create the frame of the unique gate. The extension tubes are inserted into the body gutters, and the struts are screwed in the corner gutters and on the extension tubes to define the width of the unique gate.

DETAILED DESCRIPTION OF THE INVENTION

Component

The unique adjustable guttering anti-warping anti-sagging safety-truss gate has:

a) Multiple guttering systems,
b) Multiple impact-absorbing systems,
c) Multiple anti-warping systems,
d) Multiple anti-sagging systems,
e) Multiple personal-injury-eliminating systems, and
f) Self-centering angle-locking safety truss.

Referring to FIGS. 3A and 3B, the unique adjustable guttering anti-warping anti-sagging safety-truss gate comprises:

1) Upper left corner-gutter 50,
2) Lower left corner-gutter 51,
3) Upper right corner-gutter 52,
4) Lower right corner-gutter 53,
5) Upper-left-corner-gutter drain hole 54,
6) Lower-left-corner-gutter drain hole 55,
7) Upper-right-corner-gutter drain hole 56,
8) Lower-right-corner-gutter drain hole 57,
9) Upper tunneled horizontal strut 58,
10) Lower tunneled horizontal strut 59,
11) Multiple upper-horizontal-strut tunnels 60,
12) Multiple lower-horizontal-strut tunnels 61,
13) Upper left body-gutter 62,
14) Lower left body-gutter 63,
15) Upper right body-gutter 64,
16) Lower right body-gutter 65,
17) Upper ridged tunneled extension tube 66,
18) Lower ridged tunneled extension tube 67,
19) Multiple upper-extension-tube ridges 68,
20) Multiple lower-extension-tube ridges 69,
21) Multiple upper-extension-tube tunnels 70,
22) Multiple lower-extension-tube tunnels 71,
23) Left vertical tube 72,
24) Right vertical tube 73,
25) First drain-hole system 74,
26) Second drain-hole system 75,
27) Third drain-hole system 76,
28) Fourth drain-hole system 77,
29) Fifth drain-hole system 78,
30) Sixth drain-hole system 79,
31) Seventh drain-hole system 80,
32) Eighth drain-hole system 81,
33) Upper truss hole 82,
34) Lower truss hole 83,
35) Upper left impact-absorbing anti-warping spring 84,
36) Lower left impact-absorbing anti-warping spring 85,
37) Upper right impact-absorbing anti-warping spring 86,
38) Lower right impact-absorbing anti-warping spring 87,
39) Corner-gutter contact edges 88,
40) Body-gutter contact edges 89,
41) Multiple screw-head-hiding dimples 90,
42) Multiple corner-gutter screws 91, 43) Multiple extension-tube screws 92,
44) Safety truss 93, (see FIGS. 11 and 15)
45) Turnbuckle hook 94,
46) Turnbuckle 95,
47) Cable hook 96,
48) Truss cable 97,
49) First truss-cable end 98,
50) Second truss-cable end 99,
51) Self-centering angle-locking truss-cable-end clamp 100*a*,
52) Self-centering head 100*b*,
53) Angle-locking long wing 100*c*,
54) Angle-locking short wing 100*d*, and
55) Multiple clamp screws 100*e*.

Material

Referring to FIGS. 3A and 3B:

1) Upper left corner-gutter 50 is made of metallic material.
2) Lower left corner-gutter 51 is made of metallic material.
3) Upper right corner-gutter 52 is made of metallic material.
4) Lower right corner-gutter 53 is made of metallic material.
5) Upper-left-corner-gutter drain hole 54 is made of empty space.
6) Lower-left-corner-gutter drain hole 55 is made of empty space.
7) Upper-right-corner-gutter drain hole 56 is made of empty space.
8) Lower-right-corner-gutter drain hole 57 is made of empty space.
9) Upper tunneled horizontal strut 58 is made of wood.
10) Lower tunneled horizontal strut 59 is made of wood.
11) Multiple upper-horizontal-strut tunnels 60 are made of empty space.
12) Multiple lower-horizontal-strut tunnels 61 are made of empty space.
13) Upper left body-gutter 62 is made of metallic material.
14) Lower left body-gutter 63 is made of metallic material.
15) Upper right body-gutter 64 is made of metallic material.
16) Lower right body-gutter 65 is made of metallic material.
17) Upper ridged tunneled extension tube 66 is made of metallic material.
18) Lower ridged tunneled extension tube 67 is made of metallic material.
19) Multiple upper-extension-tube ridges 68 are made of metallic material.
20) Multiple lower-extension-tube ridges 69 are made of metallic material.
21) Multiple upper-extension-tube tunnels 70 are made of empty space.
22) Multiple lower-extension-tube tunnels 71 are made of empty space.
23) Left vertical tube 72 is made of metallic material.
24) Right vertical tube 73 is made of metallic material.
25) First drain-hole system 74 is made of empty space.
26) Second drain-hole system 75 is made of empty space.
27) Third drain-hole system 76 is made of empty space.
28) Fourth drain-hole system 77 is made of empty space.
29) Fifth drain-hole system 78 is made of empty space.
30) Sixth drain-hole system 79 is made of empty space.
31) Seventh drain-hole system 80 is made of empty space.
32) Eighth drain-hole system 81 is made of empty space.
33) Upper truss hole 82 is made of empty space.
34) Lower truss hole 83 is made of empty space.
35) Upper left impact-absorbing anti-warping spring 84 is made of metallic material.
36) Lower left impact-absorbing anti-warping spring 85 is made of metallic material.
37) Upper right impact-absorbing anti-warping spring 86 is made of metallic material.
38) Lower right impact-absorbing anti-warping spring 87 is made of metallic material.
39) Corner-gutter contact edges 88 are made of metallic material.
40) Body-gutter contact edges 89 are made of metallic material.
41) Multiple screw-head-hiding dimples 90 are made of empty space.
42) Multiple corner-gutter screws 91 are made of metallic material.
43) Multiple extension-tube screws 92 are made of metallic material.
44) Safety truss 93 is made of metallic material.
45) Turnbuckle hook 94 is made of metallic material.
46) Turnbuckle 95 is made of metallic material.
47) Cable hook 96 is made of metallic material.
48) Truss cable 97 is made of metallic material.
49) First truss-cable end 98 is made of metallic material.
50) Second truss-cable end 99 is made of metallic material.
51) Self-centering angle-locking truss-cable-end clamp 100*a* is made of metallic material.
52) Self-centering head 100*b* is made of metallic material.
53) Angle-locking long wing 100*c* is made of metallic material.
54) Angle-locking short wing 100*d* is made of metallic material.
55) Multiple clamp screws 100*e* is made of metallic material.

Shape

Referring to FIGS. 3A and 3B:

1) Upper left corner-gutter 50 has a cup shape and a cross-section of a rectangular shape.
2) Lower left corner-gutter 51 has a cup shape and a cross-section of a rectangular shape.
3) Upper right corner-gutter 52 has a cup shape and a cross-section of a rectangular shape.
4) Lower right corner-gutter 53 has a cup shape and a cross-section of a rectangular shape.
5) Upper-left-corner-gutter drain hole 54 has a half-pie shape.
6) Lower-left-corner-gutter drain hole 55 has a half-pie shape.
7) Upper-right-corner-gutter drain hole 56 has a half-pie shape.
8) Lower-right-corner-gutter drain hole 57 has a half-pie shape.
9) Upper tunneled horizontal strut 58 has a cylindrical shape and a cross-section of a hand shape.
10) Lower tunneled horizontal strut 59 has a cylindrical shape and a cross-section of a hand shape.
11) Multiple upper-horizontal-strut tunnels 60 each have a cylindrical shape and a cross-section of a half-pie shape.
12) Multiple lower-horizontal-strut tunnels 61 each have a cylindrical shape and a cross-section of a half-pie shape.
13) Upper left body-gutter 62 has a cylindrical ring shape and a cross-section of a square shape.

14) Lower left body-gutter 63 has a cylindrical ring shape and a cross-section of a square shape.
15) Upper right body-gutter 64 has a cylindrical ring shape and a cross-section of a square shape.
16) Lower right body-gutter 65 has a cylindrical ring shape and a cross-section of a square shape.
17) Upper ridged tunneled extension tube 66 has a cylindrical shape and a cross-section of a hand shape.
18) Lower ridged tunneled extension tube 67 has a cylindrical shape and a cross-section of a hand shape.
19) Multiple upper-extension-tube ridges 68 each have a cylindrical shape and a cross-section of a half-pie shape.
20) Multiple lower-extension-tube ridges 69 each have a cylindrical shape and a cross-section of a half-pie shape.
21) Multiple upper-extension-tube tunnels 70 each have a cylindrical shape and a cross-section of a half-pie shape.
22) Multiple lower-extension-tube tunnels 71 each have a cylindrical shape and a cross-section of a half-pie shape.
23) Left vertical tube 72 has a cylindrical shape and a cross-section of a square shape.
24) Right vertical tube 73 has a cylindrical shape and a cross-section of a square shape.
25) First drain-hole system 74 has multiple holes of round shape.
26) Second drain-hole system 75 has multiple holes of round shape.
27) Third drain-hole system 76 has multiple holes of round shape.
28) Fourth drain-hole system 77 has multiple holes of round shape.
29) Fifth drain-hole system 78 has multiple holes of round shape.
30) Sixth drain-hole system 79 has multiple holes of round shape.
31) Seventh drain-hole system 80 has multiple holes of round shape.
32) Eighth drain-hole system 81 has multiple holes of round shape.
33) Upper truss hole 82 has a round shape.
34) Lower truss hole 83 has a round shape.
35) Upper left impact-absorbing anti-warping spring 84 has a wavy rectangular shape.
36) Lower left impact-absorbing anti-warping spring 85 has a wavy rectangular shape.
37) Upper right impact-absorbing anti-warping spring 86 has a wavy rectangular shape.
38) Lower right impact-absorbing anti-warping spring 87 has a wavy rectangular shape.
39) Corner-gutter contact edges 88 each have a straight-line shape.
40) Body-gutter contact edges 89 each have a straight-line shape.
41) Multiple screw-head-hiding dimples 90 each have a half-globe shape.
42) Multiple corner-gutter screws 91 each have a screw shape.
43) Multiple extension-tube screws 92 each have a screw shape.
44) Safety truss 93 has an elongated shape.
45) Turnbuckle hook 94 has a letter-S shape.
46) Turnbuckle 95 has an oval shape.
47) Cable hook 96 has a keyhole shape.
48) Truss cable 97 has a loop shape.
49) First truss-cable end 98 has a letter-I shape.
50) Second truss-cable end 99 has a letter-I shape.
51) Self-centering angle-locking truss-cable-end clamp 100*a* has an oval shape.
52) Self-centering head 100*b* has a cylindrical-dome shape.
53) Angle-locking long wing 100*c* has a triangular shape.
54) Angle-locking short wing 100*d* has a triangular shape.
55) Multiple clamp screws 100*e* each have a screw shape.

Connection

Referring to FIGS. 3A and 3B:

1) Upper left corner-gutter 50 is welded to upper left body-gutter 62 and left vertical tube 72 along corner-gutter contact edges 88, respectively.
2) Lower left corner-gutter 51 is welded to lower left body-gutter 63 and left vertical tube 72 along corner-gutter contact edges 88, respectively.
3) Upper right corner-gutter 52 is welded to upper right body-gutter 64 and right vertical tube 73 along corner-gutter contact edges 88, respectively.
4) Lower right corner-gutter 53 is welded to lower right body-gutter 65 and right vertical tube 73 along corner-gutter contact edges 88, respectively.
5) Upper-left-corner-gutter drain hole 54 is cut into the vertical-tube-facing side of upper left corner-gutter 50.
6) Lower-left-corner-gutter drain hole 55 is cut into the vertical-tube-facing side of lower left corner-gutter 51.
7) Upper-right-corner-gutter drain hole 56 is cut into the vertical-tube-facing side of upper right corner-gutter 52.
8) Lower-right-corner-gutter drain hole 57 is cut into the vertical-tube-facing side of upper right corner-gutter 53.
9) Upper tunneled horizontal strut 58 is inserted into upper left and upper right corner-gutters 50 and 51, at its two opposite ends, respectively.
10) Lower tunneled horizontal strut 59 is inserted into lower left and lower right corner-gutters 52 and 53, at its two opposite ends, respectively.
11) Multiple upper-horizontal-strut tunnels 60 are cut into and along the bottom of upper tunneled horizontal strut 58.
12) Multiple lower-horizontal-strut tunnels 61 are cut into and along the bottom of lower tunneled horizontal strut 59.
13) Upper left body-gutter 62 is welded to upper left corner-gutter 50 and left vertical tube 72 along body-gutter contact edges 89, respectively.
14) Lower left body-gutter 63 is welded to lower left corner-gutter 51 and left vertical tube 72 along body-gutter contact edges 89, respectively.
15) Upper right body-gutter 64 is welded to upper right corner-gutter 52 and right vertical tube 73 along body-gutter contact edges 89, respectively.
16) Lower right body-gutter 65 is welded to lower right corner-gutter 53 and right vertical tube 73 along body-gutter contact edges 89, respectively.
17) Upper ridged tunneled extension tube 66 is inserted into upper left and upper right body-gutters 62 and 63, at its two opposite ends, respectively.
18) Lower ridged tunneled extension tube 67 is inserted into lower left and lower right body-gutters 64 and 65, at its two opposite ends, respectively.
19) Multiple upper-extension-tube ridges 68 are formed into and along the bottom of upper ridged tunneled extension tube 66.
20) Multiple lower-extension-tube ridges 69 are formed into and along the bottom of lower ridged tunneled extension tube 67.
21) Multiple upper-extension-tube tunnels 70 are formed into and along the bottom of upper ridged tunneled extension tube 66.

22) Multiple lower-extension-tube tunnels 71 are formed into and along the bottom of lower ridged tunneled extension tube 67.
23) Left vertical tube 72 is welded to upper left and lower left corner-gutters 50 and 52 and to upper left and lower left body-gutters 62 and 64.
24) Right vertical tube 73 is welded to upper right and lower right corner-gutters 51 and 53 and to upper right and lower right body-gutters 63 and 65.
25) First drain-hole system 74 is drilled into the gutter-facing side of left vertical tube 72.
26) Second drain-hole system 75 is drilled into the gutter-facing side of right vertical tube 73.
27) Third drain-hole system 76 is drilled into the gutter-facing side of left vertical tube 72.
28) Fourth drain-hole system 77 is drilled into the gutter-facing side of right vertical tube 73.
29) Fifth drain-hole system 78 is drilled into the gutter-facing side of left vertical tube 72.
30) Sixth drain-hole system 79 is drilled into the gutter-facing side of right vertical tube 73.
31) Seventh drain-hole system 80 is drilled into the gutter-facing side of left vertical tube 72.
32) Eighth drain-hole system 81 is drilled into the gutter-facing side of right vertical tube 73.
33) Upper truss hole 82 is drilled into the gutter-facing side of left vertical tube 73.
34) Lower truss hole 83 is drilled into the gutter-facing side of right vertical tube 73.
35) Upper left impact-absorbing anti-warping spring 84 is diagonally welded, along its two opposite vertical edges, to the inner surface of left vertical tube 72.
36) Lower left impact-absorbing anti-warping spring 85 is diagonally welded, along its two opposite vertical edges, to the inner surface of left vertical tube 72.
37) Upper right impact-absorbing anti-warping spring 86 is diagonally welded, along its two opposite vertical edges, to the inner surface of right vertical tube 73.
38) Lower right impact-absorbing anti-warping spring 87 is diagonally welded, along its two opposite vertical edges, to the inner surface of right vertical tube 73.
39) Corner-gutter contact edges 88 are formed along the contact perimeter of corner-gutters 50, 51, 52, and 53.
40) Body-gutter contact edges 89 are formed along the contact perimeter of body-gutters 62, 63, 64, and 65.
41) Multiple screw-head-hiding dimples 90 are formed into the fence-board-facing side of corner-gutters 50, 51, 52, and 53.
42) Multiple corner-gutter screws 91 are screwed through multiple screw-head-hiding dimples 90, respectively.
43) Multiple extension-tube screws 92 are screwed through upper and lower extension tubes 66, 67 and upper and lower tunneled horizontal struts 58 and 59.
44) Safety truss 93 is attached to left and right vertical tubes 72 and 73.
45) Turnbuckle hook 94 is hooked in upper truss hole 82.
46) Turnbuckle 95 is screwed on turnbuckle hook 94 and cable hook 96.
47) Cable hook 96 is screwed in turnbuckle 95.
48) Truss cable 97 is threaded through cable hook 96.
49) First truss-cable end 98 is inserted in lower truss hole 83.
50) Second truss-cable end 99 is inserted in lower truss hole 83.
51) Self-centering angle-locking truss-cable-end clamp 100*a* is screwed on first and second truss-cable ends 96 and 97.
52) Self-centering head 100*b* is molded to the side of truss-cable-end clamp 100*a*.
53) Angle-locking long wing 100*c* is molded to a corner of truss-cable-end clamp 100*a*.
54) Angle-locking short wing 100*d* is molded to another corner of truss-cable-end clamp 100*a*.
55) Multiple clamp screws 100*e* are screwed on truss-cable-end clamp 100*a*.

Function

Referring to FIGS. 3A, 3B, 4, 5, 6, 7, 8, 9, 10, 11, 12, 13, 14, and 15:

1) Upper left corner-gutter 50 is for leading rain water trapped between upper left corner-gutter 50 and upper tunneled horizontal strut 58 to first drain-hole system 74, in the direction of arrow 101 (FIG. 4).
2) Lower left corner-gutter 51 is for leading rain water trapped between lower left corner-gutter 51 and lower tunneled horizontal strut 59 to second drain-hole system 75, in the direction of arrow 102 (FIG. 5).
3) Upper right corner-gutter 52 is for leading rain water trapped between upper right corner-gutter 52 and upper tunneled horizontal strut 58 to third drain-hole system 76.
4) Lower right corner-gutter 53 is for leading rain water trapped between lower right corner-gutter 53 and lower tunneled horizontal strut 59 to fourth drain-hole system 77.
5) Upper-left-corner-gutter drain hole 54 is for draining rain water into left vertical tube 72.
6) Lower-left-corner-gutter drain hole 55 is for draining rain water into left vertical tube 72.
7) Upper-right-corner-gutter drain hole 56 is for draining rain water into right vertical tube 73.
8) Lower-right-corner-gutter drain hole 57 is for draining rain water into right vertical tube 73.
9) Upper tunneled horizontal strut 58 is for fixing the unique-gate width (FIG. 6).
10) Lower tunneled horizontal strut 59 is for fixing the unique-gate width.
11) Multiple upper-horizontal-strut tunnels 60 are for leading trapped rain water to first and third drain-hole systems 74 and 76, in the directions of arrows 103 and 104 (FIGS. 6 and 7).
12) Multiple lower-horizontal-strut tunnels 61 are for leading trapped rain water to second and fourth drain-hole systems 76 and 77.
13) Upper left body-gutter 62 is for leading rain water trapped between upper left body-gutter 62 and upper ridged tunneled extension tube 66 to fifth drain-hole system 78, in the direction of arrow 105 (FIG. 10).
14) Lower left body-gutter 63 is for leading rain water trapped between lower left body-gutter 63 and lower ridged tunneled extension tube 67 to sixth drain-hole system 79, in the direction of arrow 106 (FIG. 10)
15) Upper right body-gutter 64 is for leading rain water trapped between upper right body-gutter 64 and upper ridged tunneled extension tube 66 to seventh drain-hole system 80.
16) Lower right body-gutter 65 is for leading rain water trapped between lower right body-gutter 65 and lower ridged tunneled extension tube 67 to eighth drain-hole system 81.
17) Upper ridged tunneled extension tube 66 is for adjusting the unique-gate width (FIG. 8).
18) Lower ridged tunneled extension tube 67 is for adjusting the unique-gate width.

Figure 8:
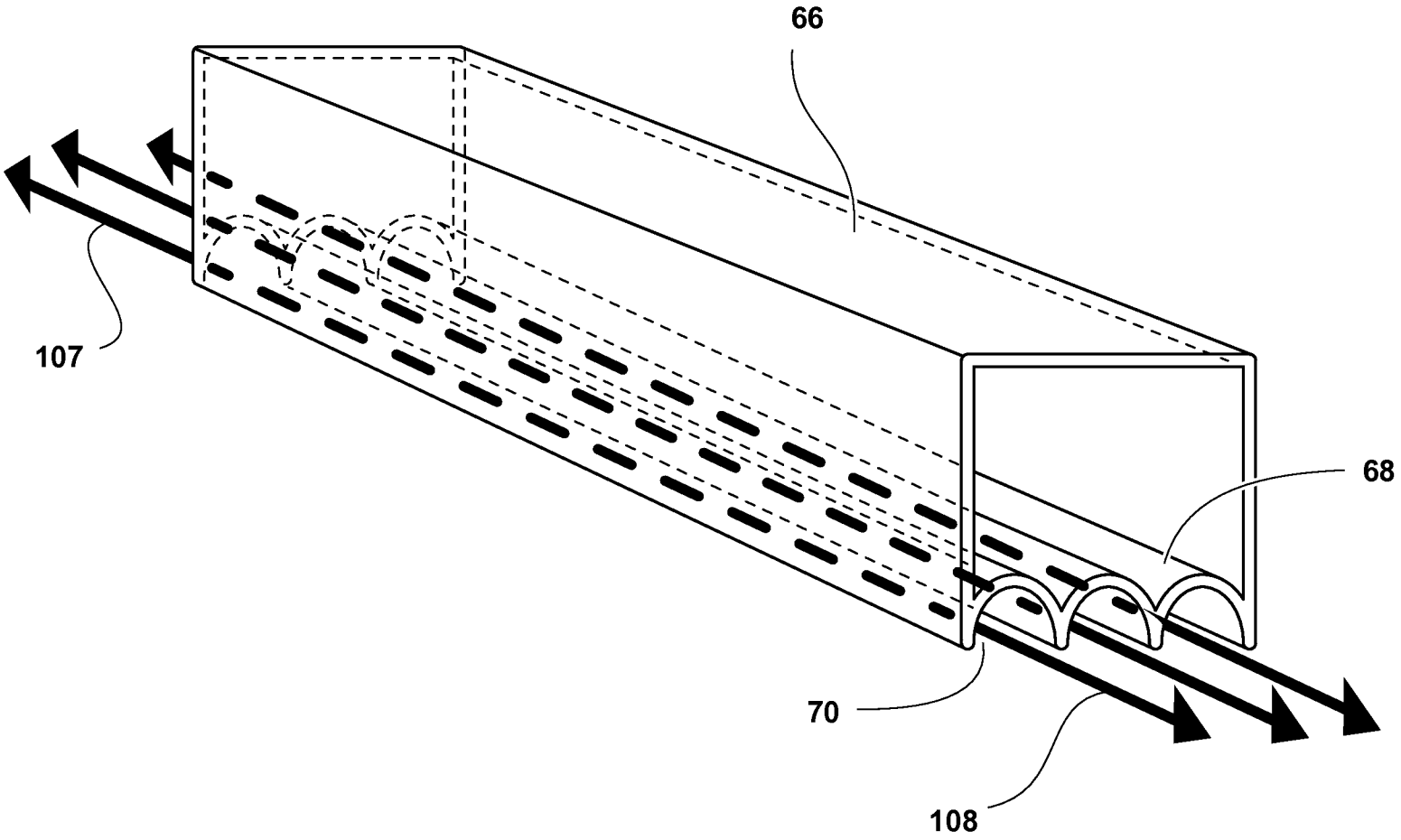
FIG. 8 illustrates a perspective view of a unique ridged tunneled extension tube having multiple built-in ridges and tunnels.
Figure 9:
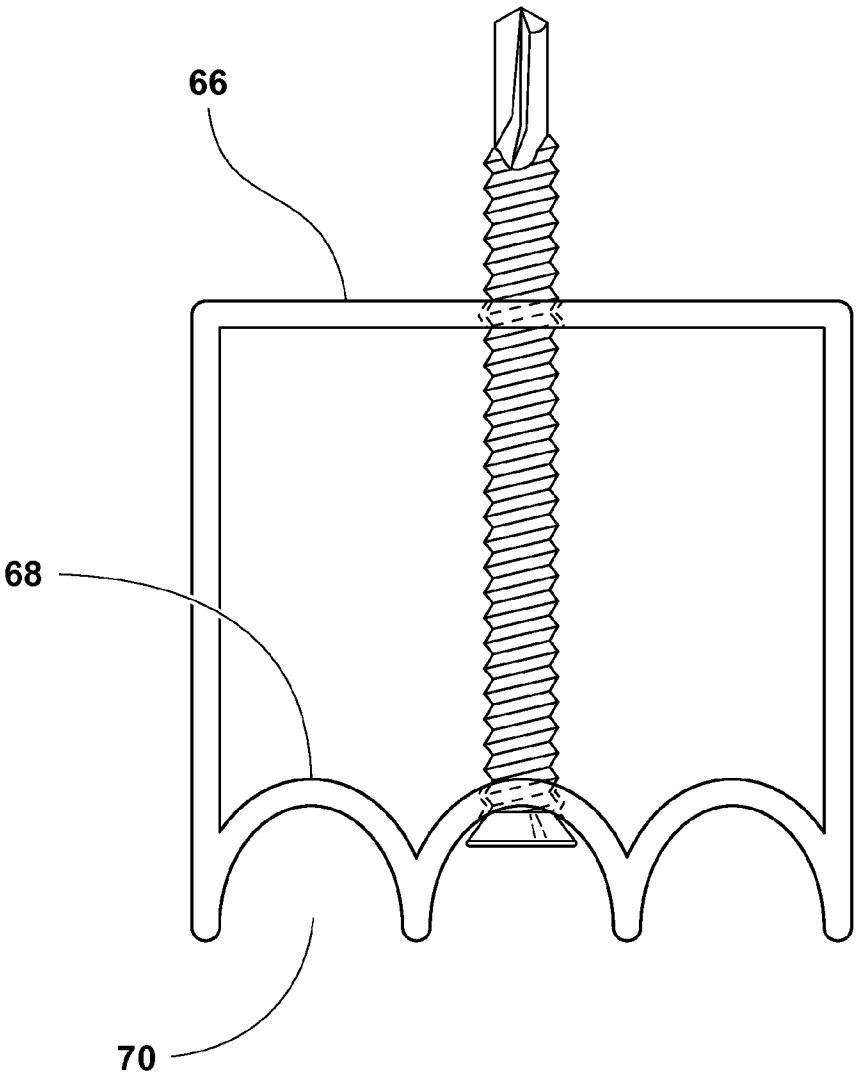
FIG. 9 illustrates a side view of a unique ridged tunneled extension tube having multiple built-in ridges and tunnels.

19) Multiple upper-extension-tube ridges 68 are for strengthening upper ridged tunneled extension tube 66 (FIGS. 8 and 9).

20) Multiple lower-extension-tube ridges 69 are for strengthening lower ridged tunneled extension tube 67.

21) Multiple upper-extension-tube tunnels 70 are for leading trapped rain water to fifth and seventh drain-hole systems 78 and 80, in the directions of arrows 107 and 108 (FIGS. 8 and 9).

22) Multiple lower-extension-tube tunnels 71 are for leading trapped rain water to sixth and eighth drain-hole systems 80 and 81.

Figure 10:
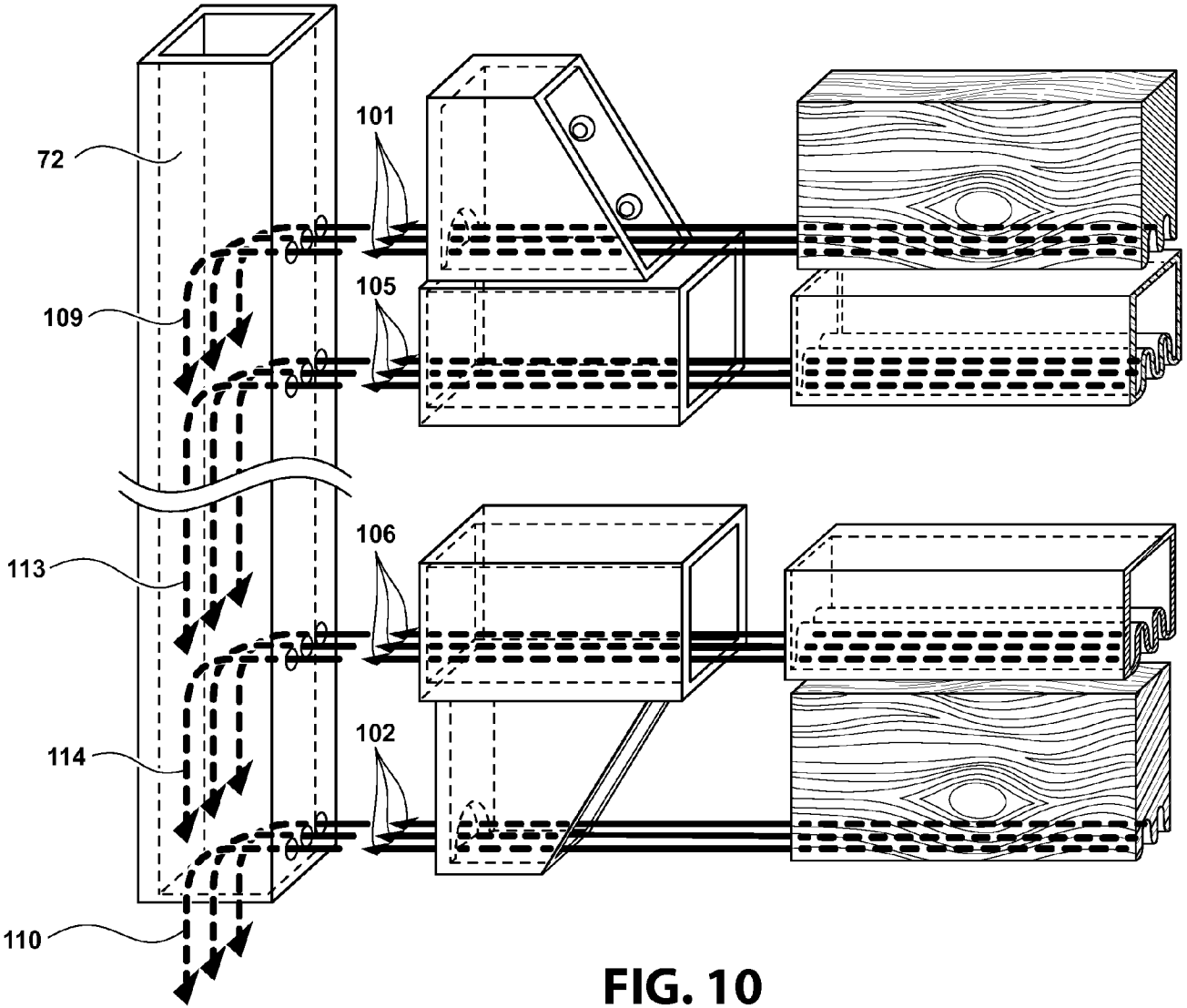
FIG. 10 illustrates a perspective view how multiple unique built-in guttering systems discharge rain water through the unique adjustable guttering anti-warping anti-sagging safety-truss gate, and down to the ground.
Figure 11:
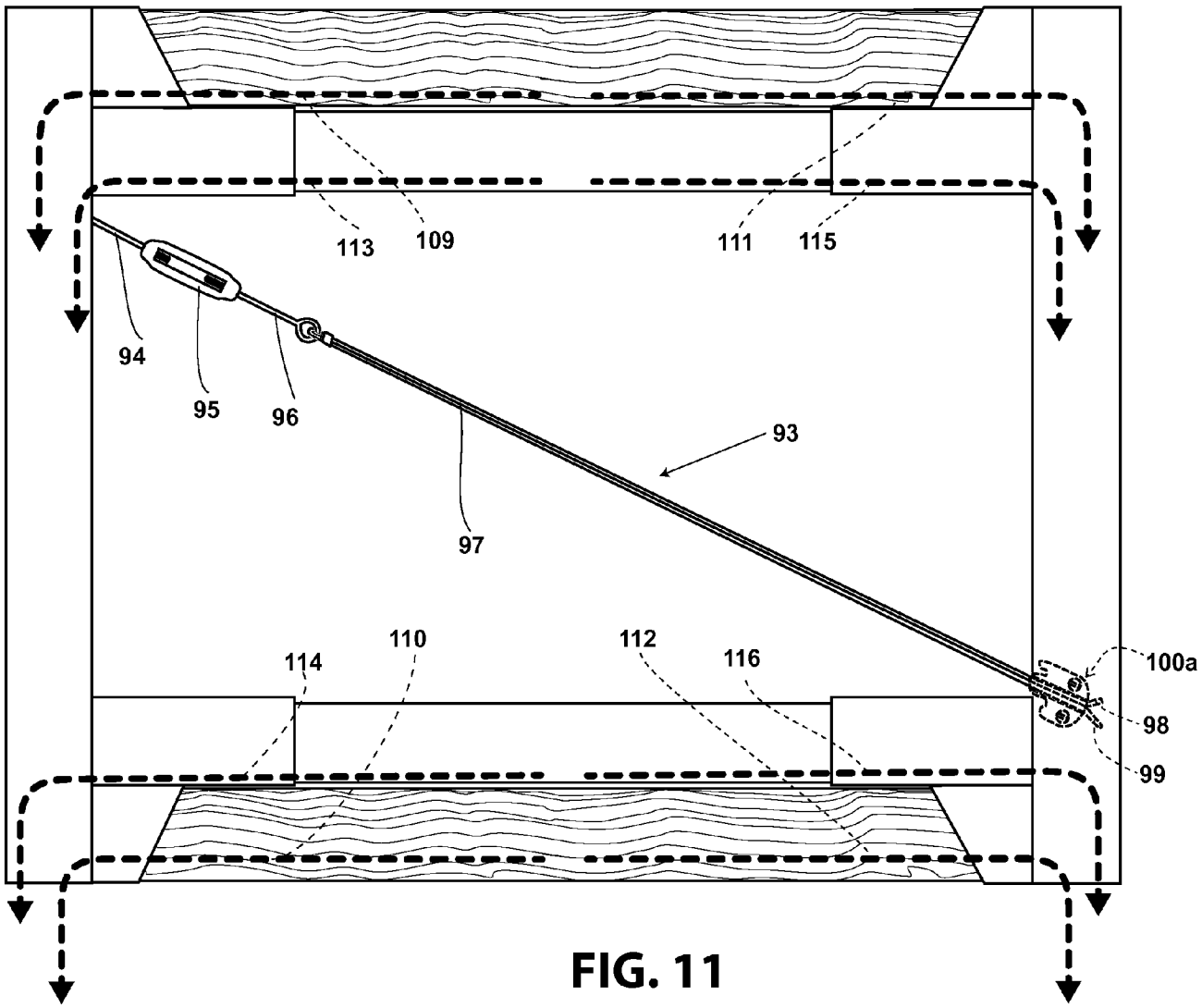
FIG. 11 illustrates a front view how multiple unique built-in guttering systems discharge rain water through the unique adjustable guttering-system anti-warping anti-sagging safety-truss gate, and down to the ground.

23) Left vertical tube 72 is for leading trapped rain water down to the ground,
(FIGS. 10 and 11).

24) Right vertical tube 73 is for leading trapped rain water down to the ground.

25) First drain-hole system 74 is for draining rain water into left vertical tube 72, in the direction of arrow 109 (FIGS. 10 and 11).

26) Second drain-hole system 75 is for draining rain water into left vertical tube 72, in the direction of arrow 110 (FIGS. 10 and 11).

27) Third drain-hole system 76 is for draining rain water into right vertical tube 73, in the direction of arrow 111 (FIGS. 10 and 11).

28) Fourth drain-hole system 77 is for draining rain water into right vertical tube 73, in the direction of arrow 112 (FIGS. 10 and 11).

29) Fifth drain-hole system 78 is for draining rain water into left vertical tube 72, in the direction of arrow 113 (FIGS. 10 and 11).

30) Sixth drain-hole system 79 is for draining rain water into left vertical tube 72, in the direction of arrow 114 (FIGS. 10 and 11).

31) Seventh drain-hole system 80 is for draining rain water into right vertical tube 73, in the direction of arrow 115 (FIGS. 10 and 11).

32) Eighth drain-hole system 81 is for draining rain water into right vertical tube 73, in the direction of arrow 116 (FIGS. 10 and 11).

33) Upper truss hole 82 is for truss hook 94 to hook into.

34) Lower truss hole 83 is for first and second truss-cable ends 96 and 97 to be threaded through.

Figure 12:
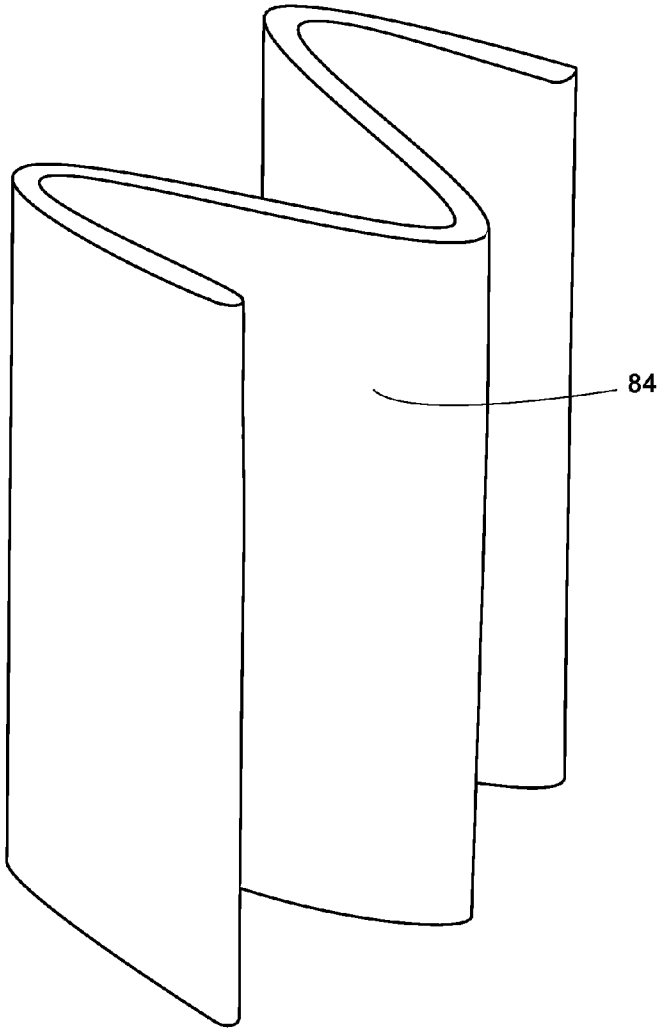
FIG. 12 illustrates a perspective view of a unique impact-absorbing anti-warping spring.
Figure 13:
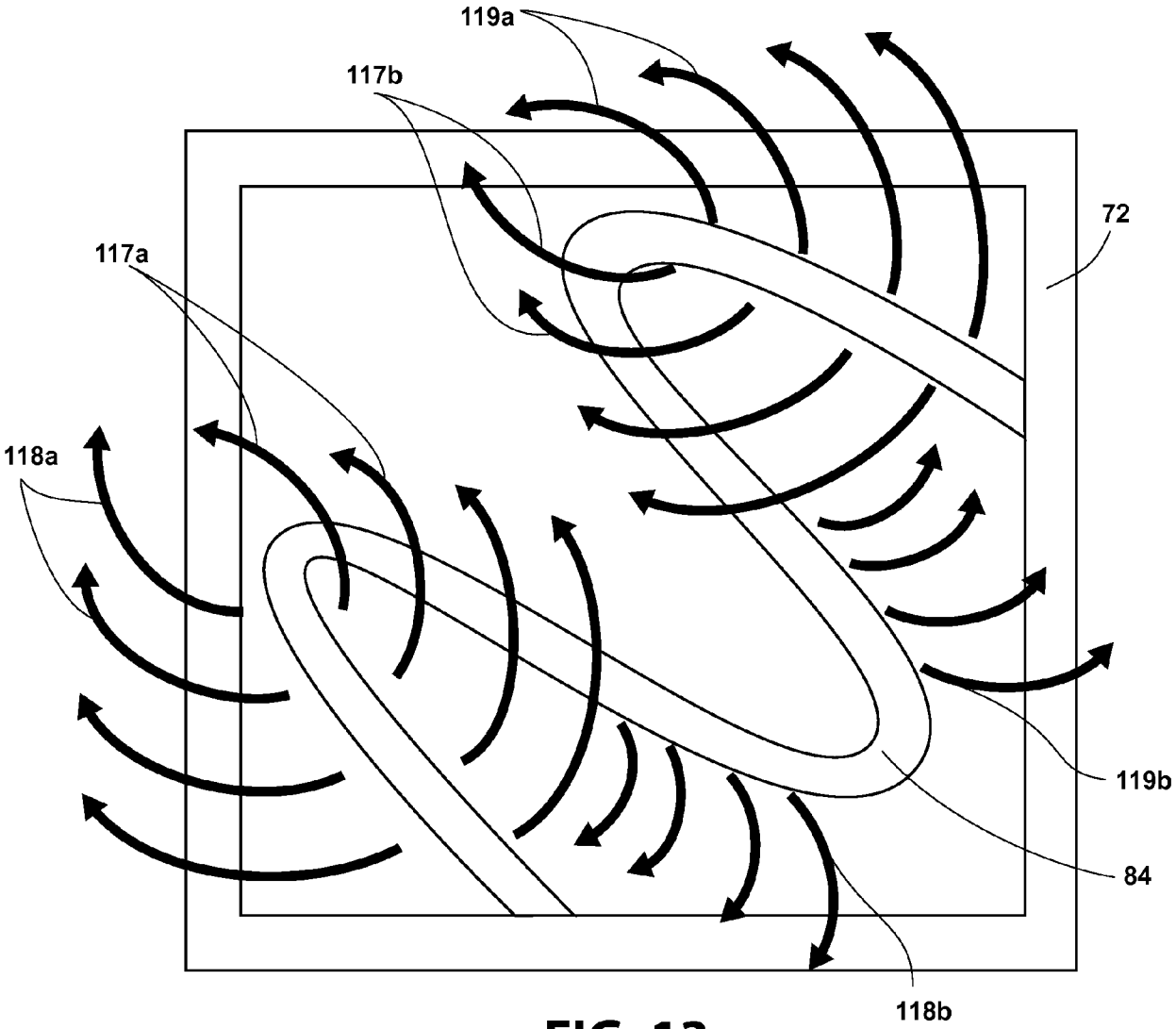
FIG. 13 illustrates a top view of a unique impact-absorbing anti-warping spring with impact forces, warping forces, impact-absorbing forces, and anti-warping forces.

35) Upper left impact-absorbing anti-warping spring 84 is for:
a) Absorbing gravitational, impacting, and warping forces 117*a* with its spring forces 118*a* and 118*b* (FIGS. 12 and 13), and
b) Absorbing gravitational, impacting, and warping forces 117*b* with its spring forces 119*a* and 119*b* (FIGS. 12 and 13).

36) Lower left impact-absorbing anti-warping spring 85 is for:
a) Absorbing gravitational, impacting, and warping forces with its left spring forces (similarly to upper left impact-absorbing anti-warping spring 84 above), and
b) Absorbing gravitational, impacting, and warping forces with its right spring forces (similarly to upper left impact-absorbing anti-warping spring 84 above). (FIGS. 12 and 13).

37) Upper right impact-absorbing anti-warping spring 86 is for:
a) Absorbing gravitational, impacting, and warping forces with its left spring forces (similarly to upper left impact-absorbing anti-warping spring 84 above), and
b) Absorbing gravitational, impacting, and warping forces with its right spring forces (similarly to upper left impact-absorbing anti-warping spring 84 above). (FIGS. 12 and 13).

38) Lower right impact-absorbing anti-warping spring 87 is for:
a) Absorbing gravitational, impacting, and warping forces with its left spring forces (similarly to upper left impact-absorbing anti-warping spring 84 above), and
b) Absorbing gravitational, impacting, and warping forces with its right spring forces (similarly to upper left impact-absorbing anti-warping spring 84 above). (FIGS. 12 and 13).

Figure 14:
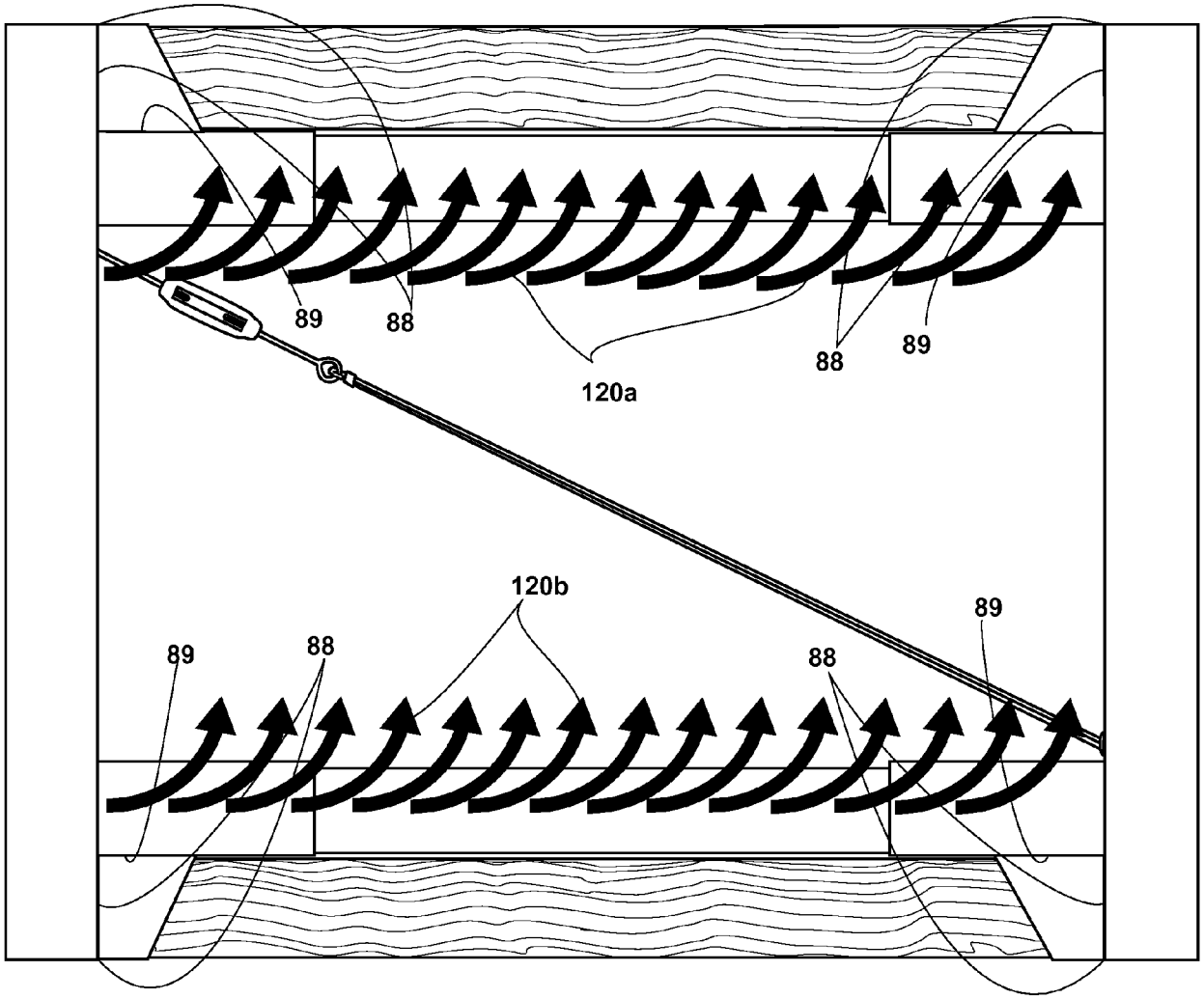
FIG. 14 illustrates a front view of corner-gutter contact edges and body-gutter contact edges, which are welded to counteract the gravitational forces, impact forces, warping and sagging forces.

39) Corner-gutter contact edges 88 are for being welded to body-gutters 62, 63, 64, and 65 and to vertical tubes 72 and 73, respectively (FIGS. 3B and 14).

40) Body-gutter contact edges 89 are for being welded to corner-gutters 50, 51, 52, and 53 and to vertical tubes 72 and 73, respectively (FIGS. 3B and 14).

Figure 4:
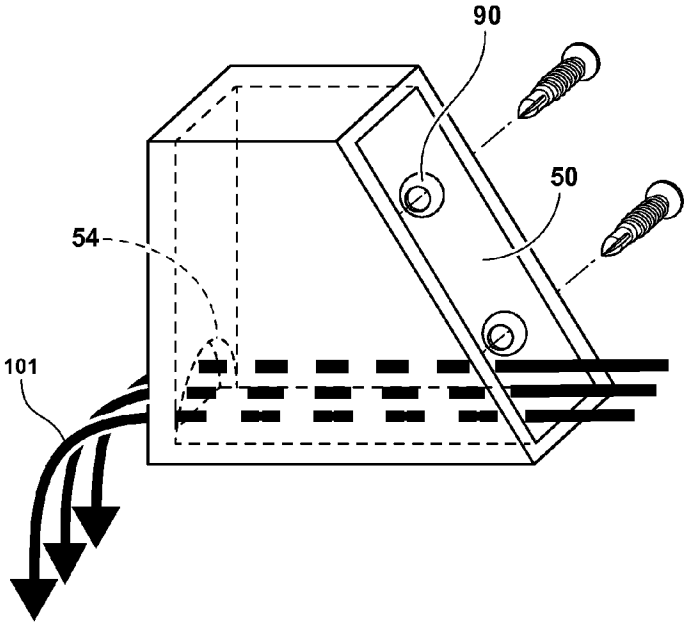
FIGS. 4 and 5 illustrate perspective views of unique corner gutters having multiple built-in drain holes.
Figure 5:
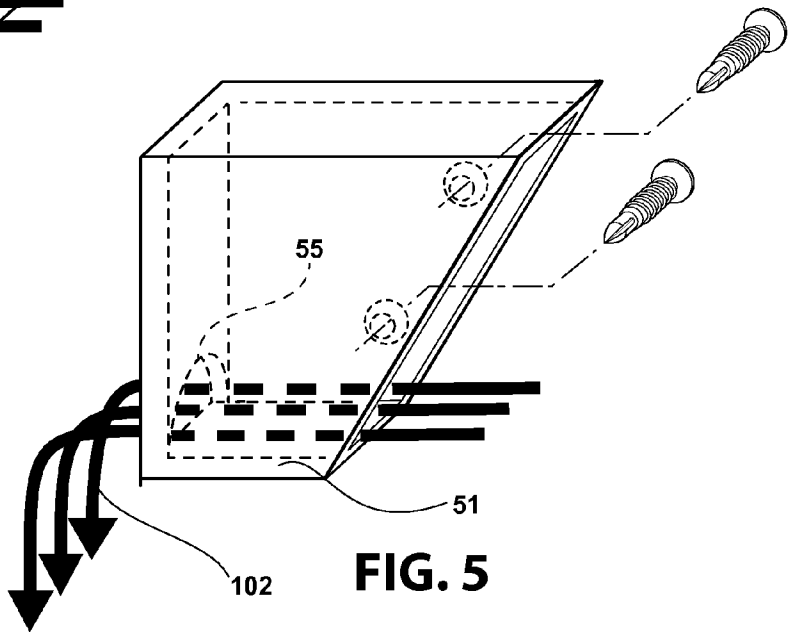
Figure 6:
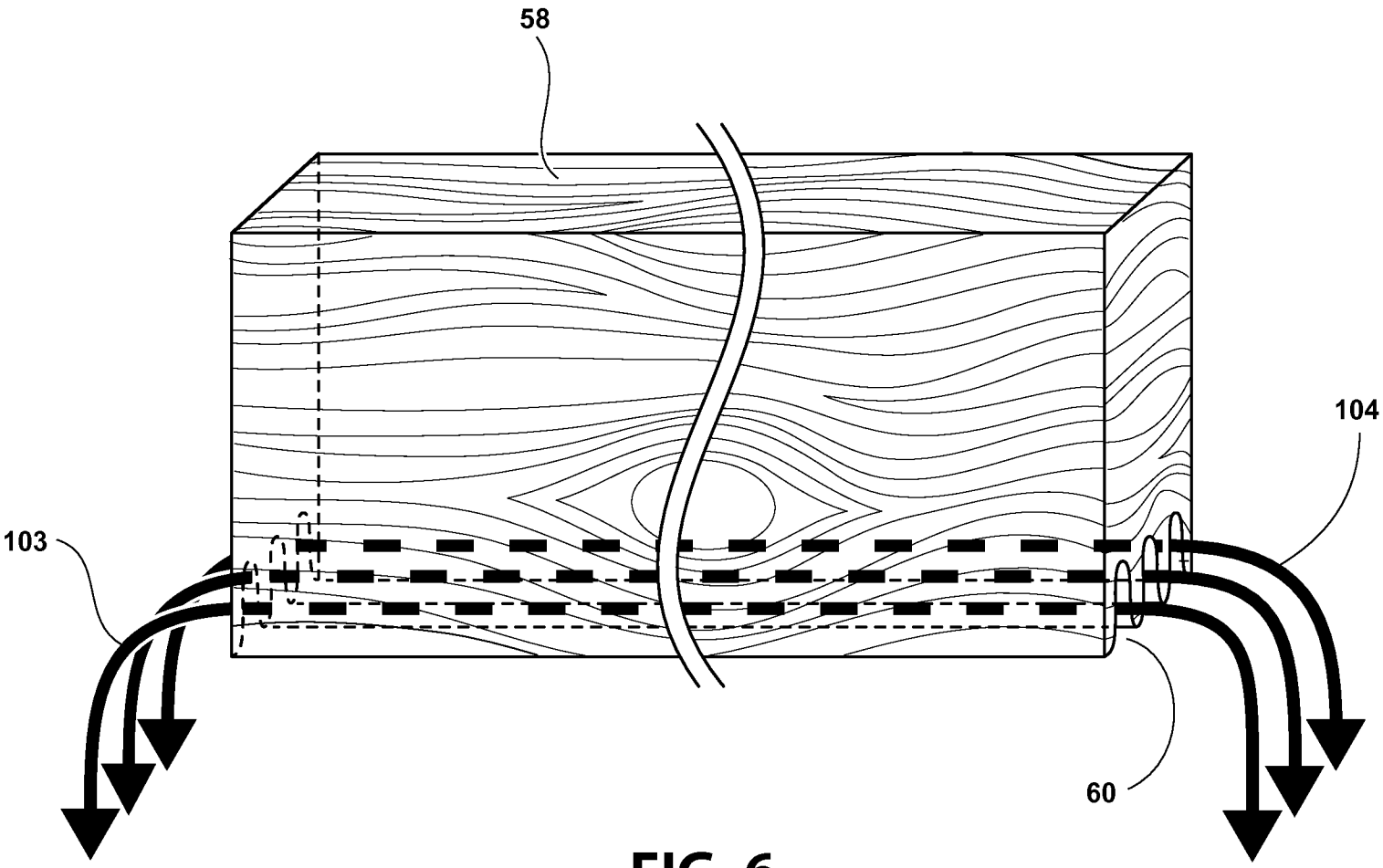
FIG. 6 illustrates a perspective view of a unique tunneled horizontal strut having multiple built-in drain tunnels.
Figure 7:
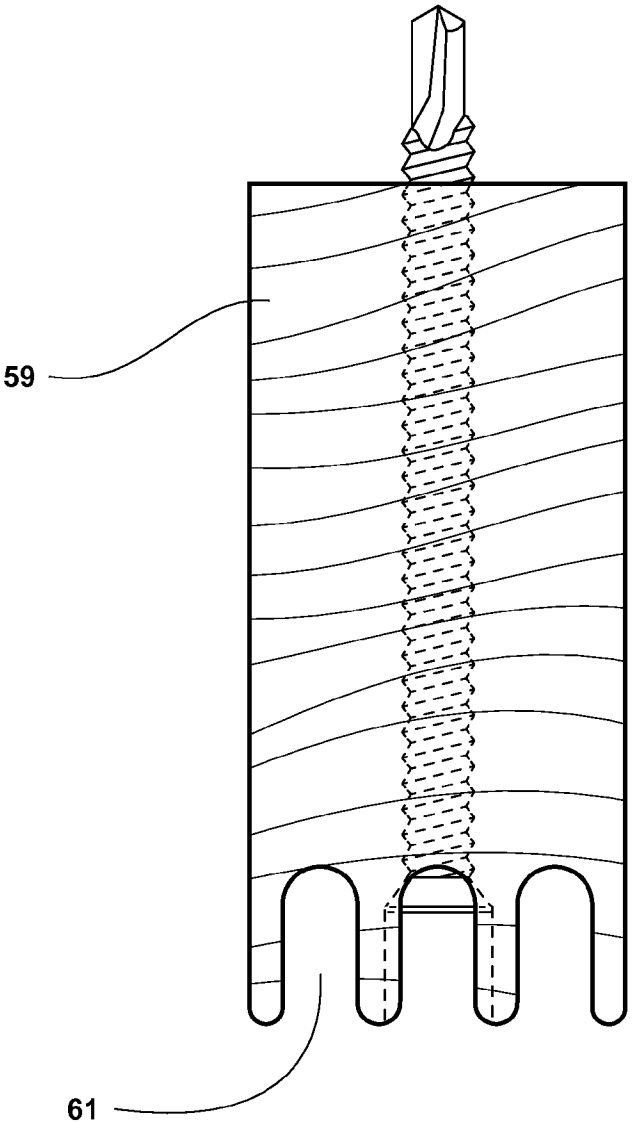
FIG. 7 illustrates a side view of a unique tunneled horizontal strut having multiple built-in drain tunnels.

41) Multiple screw-head-hiding dimples 90 are for hiding the heads of corner-gutter screws 91 (FIGS. 3A and 4).

42) Multiple corner-gutter screws 91 are for securing upper and lower tunneled horizontal strut 58 and 59 to upper and lower corner-gutters 50, 51, 52, and 53 (FIG. 3A).

43) Multiple extension-tube screws 92 are for securing upper and lower extension tube 66 and 67 to upper and lower body-gutters 62, 63, 64, and 65 (FIG. 3A).

Figure 15:
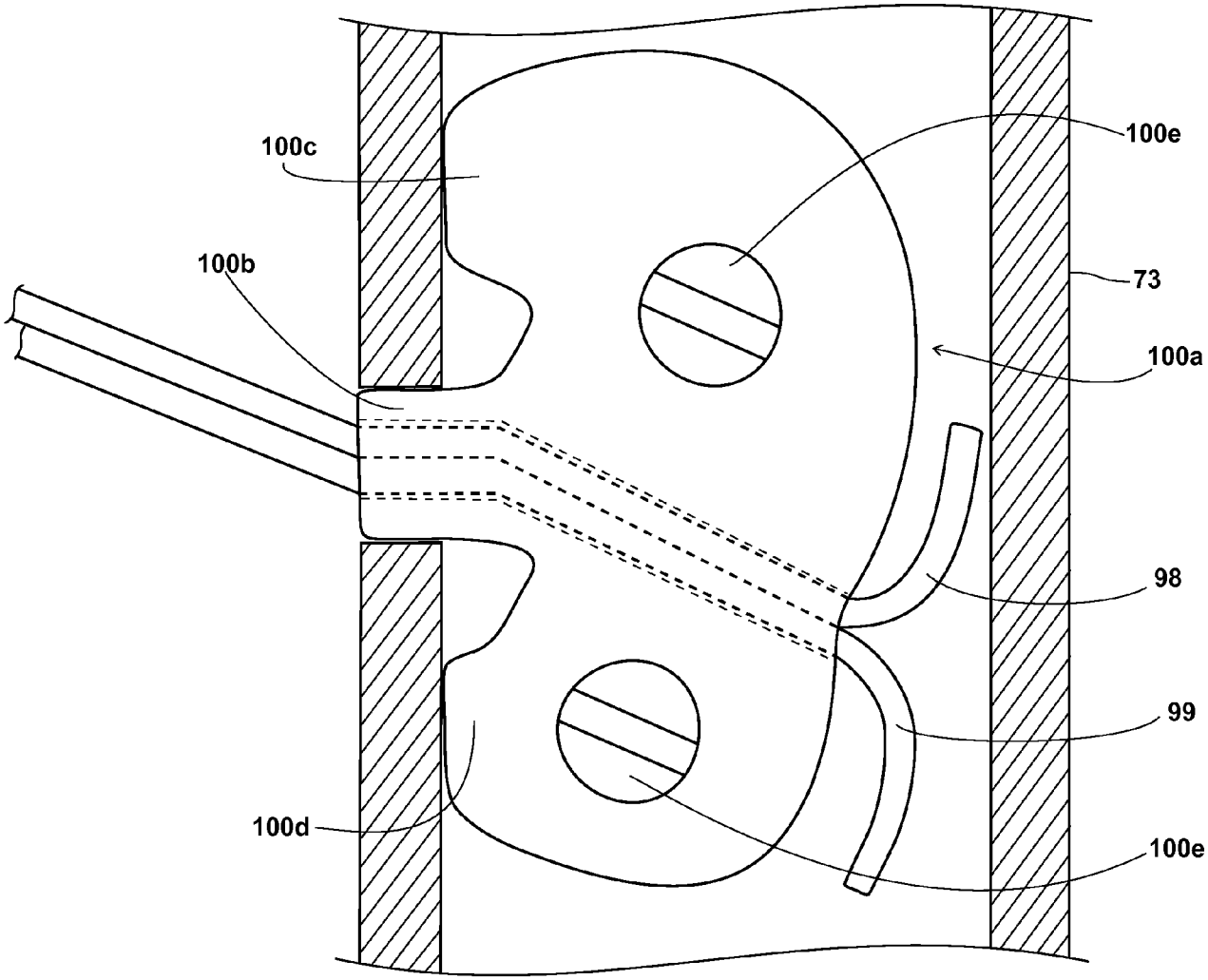
FIG. 15 illustrates a front view of a unique self-centering angle-locking truss-cable-end clamp.

44) Safety truss 93 is for maintaining the original unique-gate shape (FIGS. 14 and 15).

45) Turnbuckle hook 94 is for hooking into upper truss hole 82.

46) Turnbuckle 95 is for adjusting the truss tension.

47) Cable hook 96 is for truss cable 97 to be hooked thereon.

48) Truss cable 97 is for maintaining the tension of safety truss 93

49) First truss-cable end 98 is for being inserted in lower truss hole 83 (FIGS. 14 and 15).

50) Second truss-cable end 99 is for being inserted in lower truss hole 83 (FIGS. 14 and 15).

51) Self-centering angle-locking truss-cable-end clamp 100*a* is for locking first and second truss-cable ends 98 and 99 in an angle inside right vertical tube 73 (FIGS. 14 and 15):

52) Self-centering head 100*b* is for centering truss-cable-end clamp 100*a* at the center of lower truss hole 83 when the tension of truss cable 97 is adjusted.

53) Angle-locking long wing 100*c* is for locking truss-cable-end clamp 100*a* in an angle inside right vertical tube 73 when the tension of truss cable 97 is adjusted.

54) Angle-locking short wing 100*d* is for locking truss-cable-end clamp 100*a* in an angle inside right vertical tube 73 when the tension of truss cable 97 is adjusted.

55) Multiple clamp screws 100*e* are for screwing truss-cable-end clamp 100*a* on first and second truss-cable ends 98 and 99.

Operation

Figure 2:
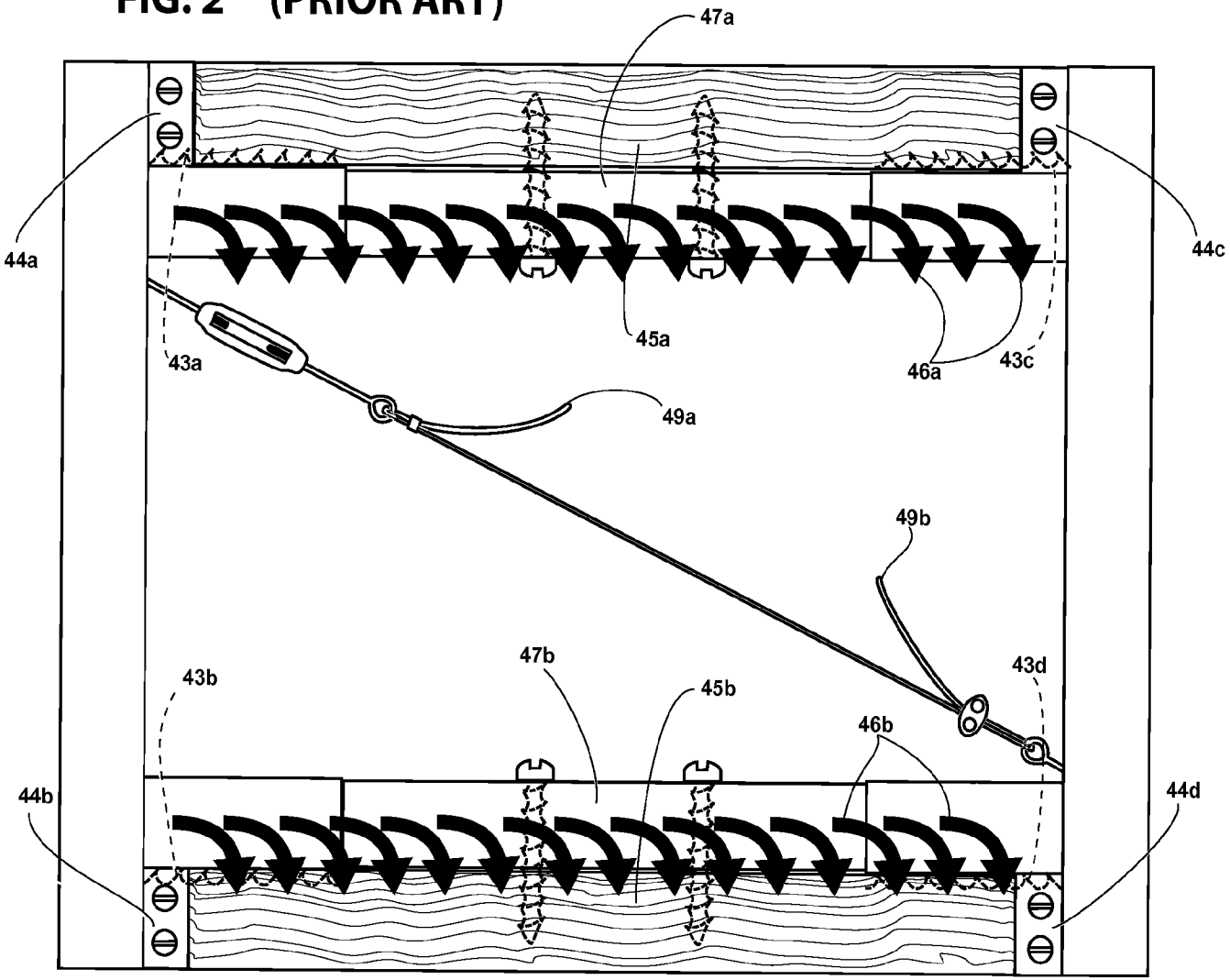
FIG. 2 (PRIOR ART)
FIG. 2 (PRIOR ART) illustrates a front view of a prior-art adjustable gate with many disadvantages of hazardous exposed rusted screw heads and hazardous trapped rain-water pools.
Figure 16:
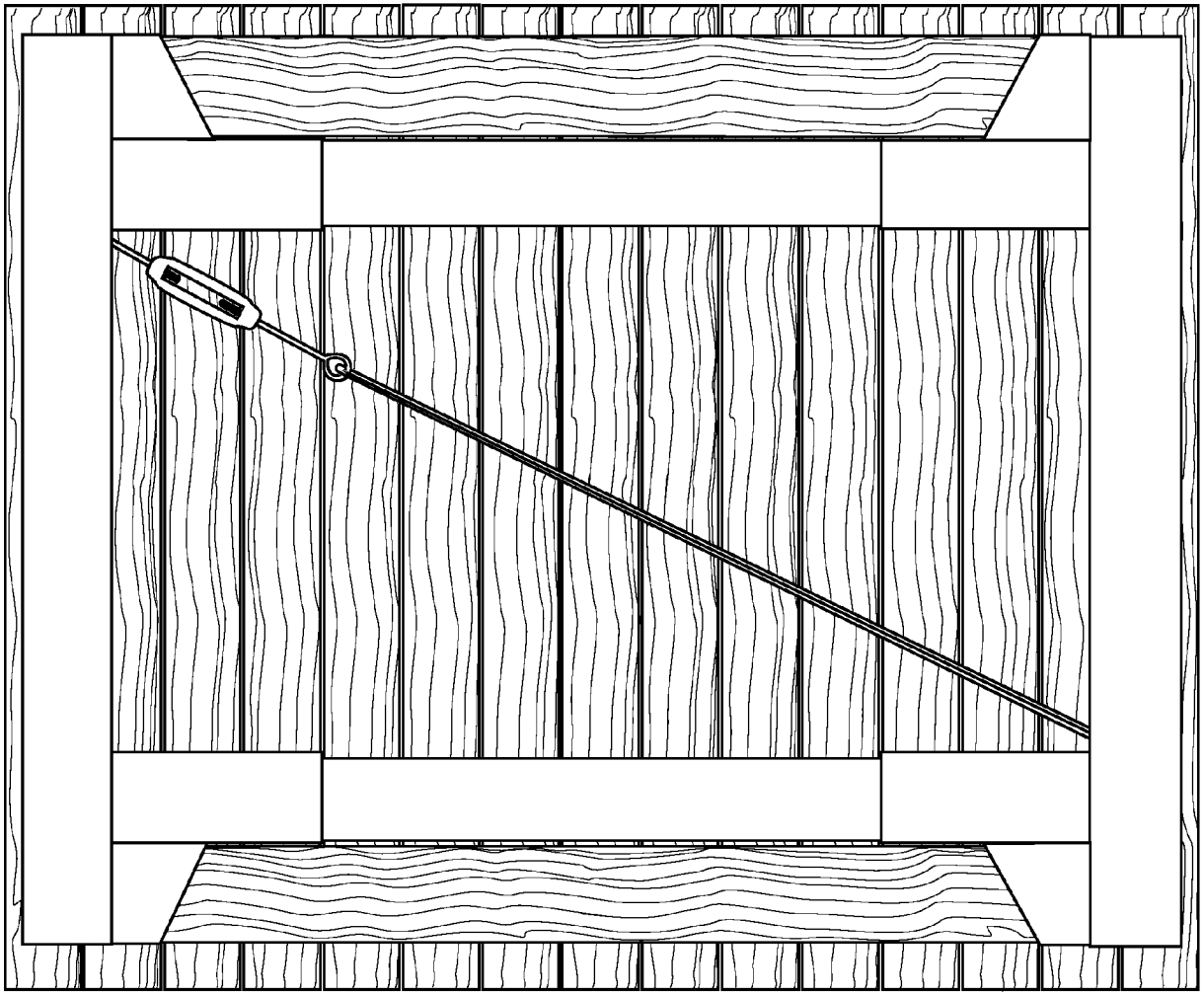
FIG. 16 illustrates a front view of the unique adjustable guttering anti-warping anti-sagging safety-truss gate with fence boards screwed thereon.

Referring to FIGS. 3A, 3B, 11, 12, 13, 14, 15, and 16, the operation of the unique adjustable guttering anti-warping anti-sagging safety-truss gate comprises:

1) Welding corner-gutters 50, 51, 52, 53 to body-gutters 62, 63, 64, 65, respectively;

2) Welding corner-gutters 50, 51, 52, 53 and body-gutters 62, 63, 64, 65 to
left and right vertical tubes 72 and 73, along their respective contact edges, to generate counteracting forces 120*a* and 120*b* (FIG. 14), which counteract gravitational forces 46*a* and 46*b* (FIG. 2 (PRIOR ART)

exerted on the unique adjustable guttering anti-warping anti-sagging safety-truss gate during its lifespan (for example, welding corner-gutters 50, body-gutters 62, and left vertical tube 72 to one another, along corner-gutter contact edges 88 and along body-gutter contact edges 89, respectively (FIGS. 3A and 3B);

3) Welding impact-absorbing anti-warping springs 84, 85, 86, 87 to
   the inside surfaces of left and right vertical tubes 72 and 73, respectively,
   to absorb the slamming forces and warping forces exerted on the unique adjustable guttering anti-warping anti-sagging safety-truss gate during its lifespan
   (FIGS. 3A, 3B, 12, and 13);
4) Inserting tunneled horizontal struts 58 and 59 into corner-gutters 50, 51, 52, 53, respectively (FIG. 11);
5) Inserting ridged tunneled extension tubes 66 and 67 into body-gutters 62, 63, 64, 65, respectively;
6) Screwing tunneled horizontal struts 58 and 59 to corner-gutters 50, 51, 52, 53, with corner-gutter screws 91, respectively;
7) Screwing ridged tunneled extension tube 66 and 67 to tunneled horizontal struts 58 and 59, with extension-tube screws 92, respectively;
8) Hooking turnbuckle hook 94 in upper truss hole 82 (FIG. 11);
9) Screwing turnbuckle 95 on turnbuckle hook 94 and cable hook 96;
10) Threading truss cable 97 through cable hook 96;
11) Inserting first and second truss-cable ends 98 and 99 into lower truss hole 83
   to hide them inside right vertical tube 73;
12) Screwing self-centering angle-locking truss-cable-end clamp 100*a* on first and second truss-cable ends 98 and 99, using clamp screws 100*e*,
   to secure first and second truss-cable ends 98 and 99 inside right vertical tube 73
   (FIGS. 11 and 15);
13) Rotating turnbuckle 95 to adjust the tension of truss cable 97; and
14) Screwing fence boards on the unique adjustable guttering anti-warping anti-sagging safety-truss gate (FIG. 16).

Variation

Figure 17:
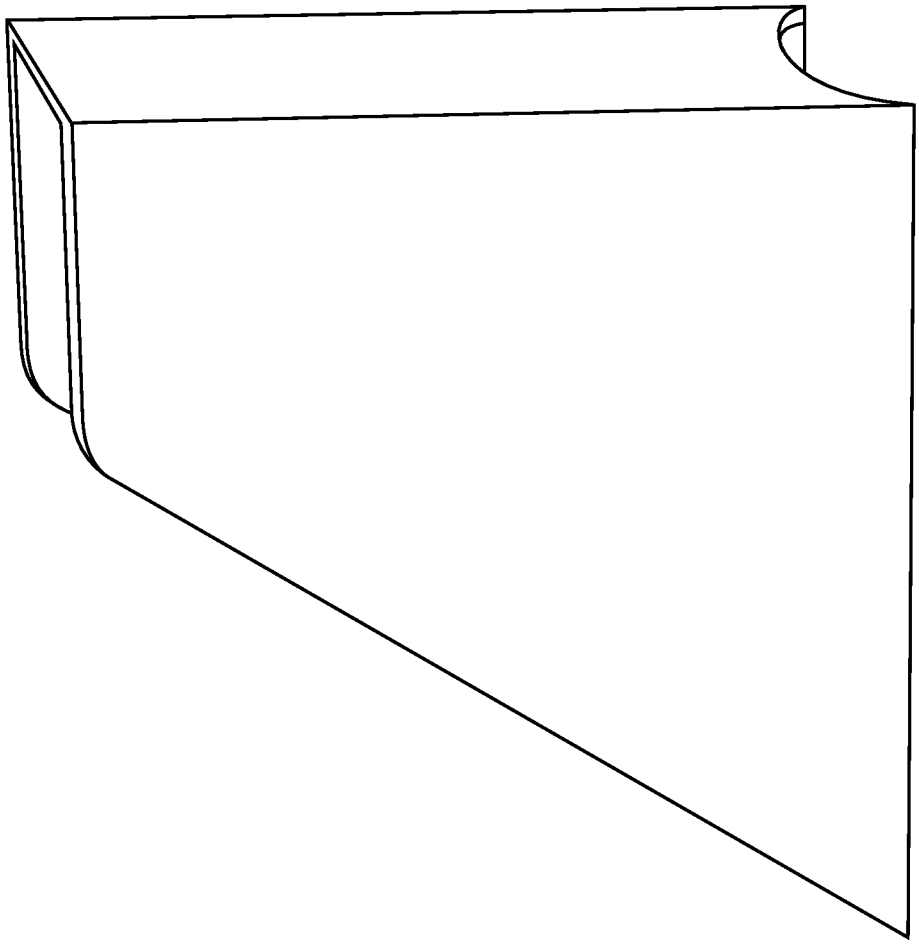
FIG. 17 illustrates a perspective view of an equivalent of the unique corner gutter.
Figure 18:
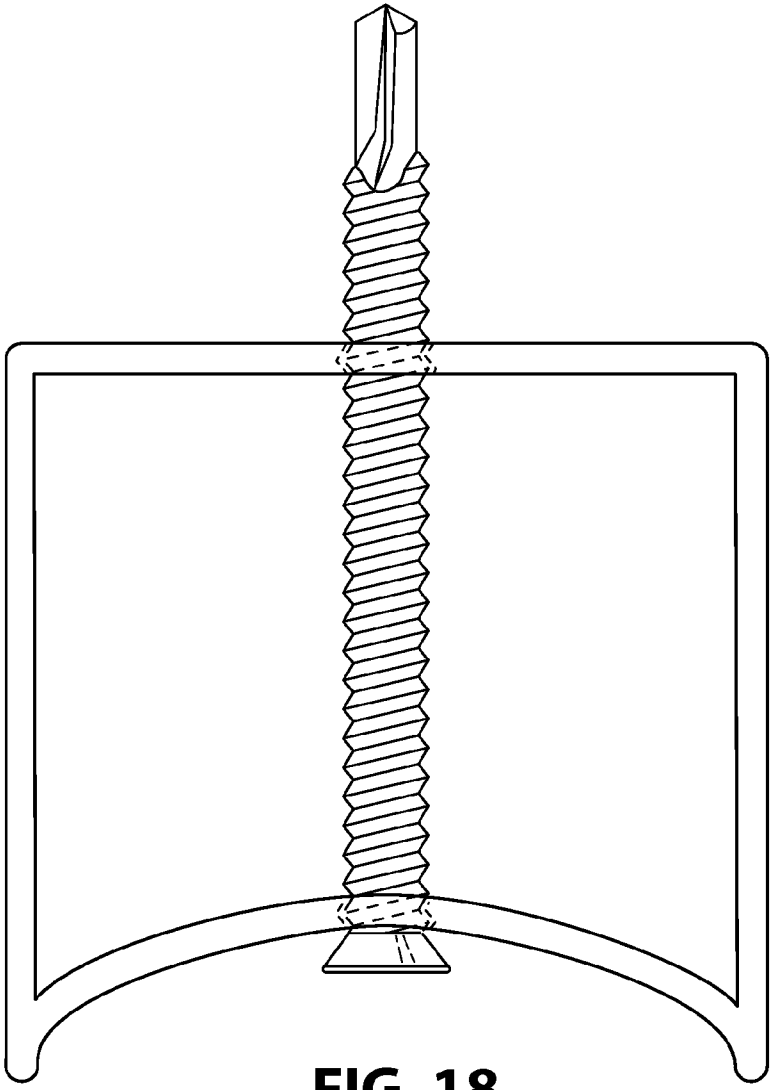
FIG. 18 illustrates a front view of an equivalent of the unique ridged tunneled extension tube.
Figure 19:
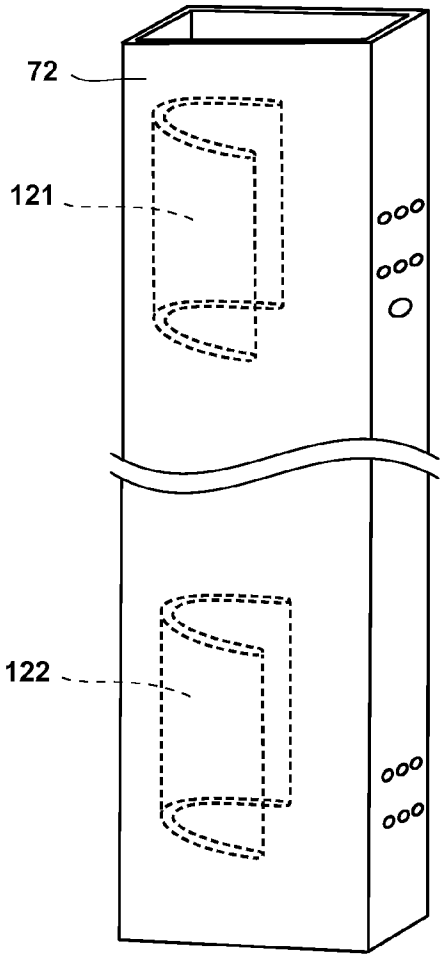
FIG. 19 illustrates a perspective view of an equivalent of the unique impact-absorbing anti-warping spring.
Figure 20:
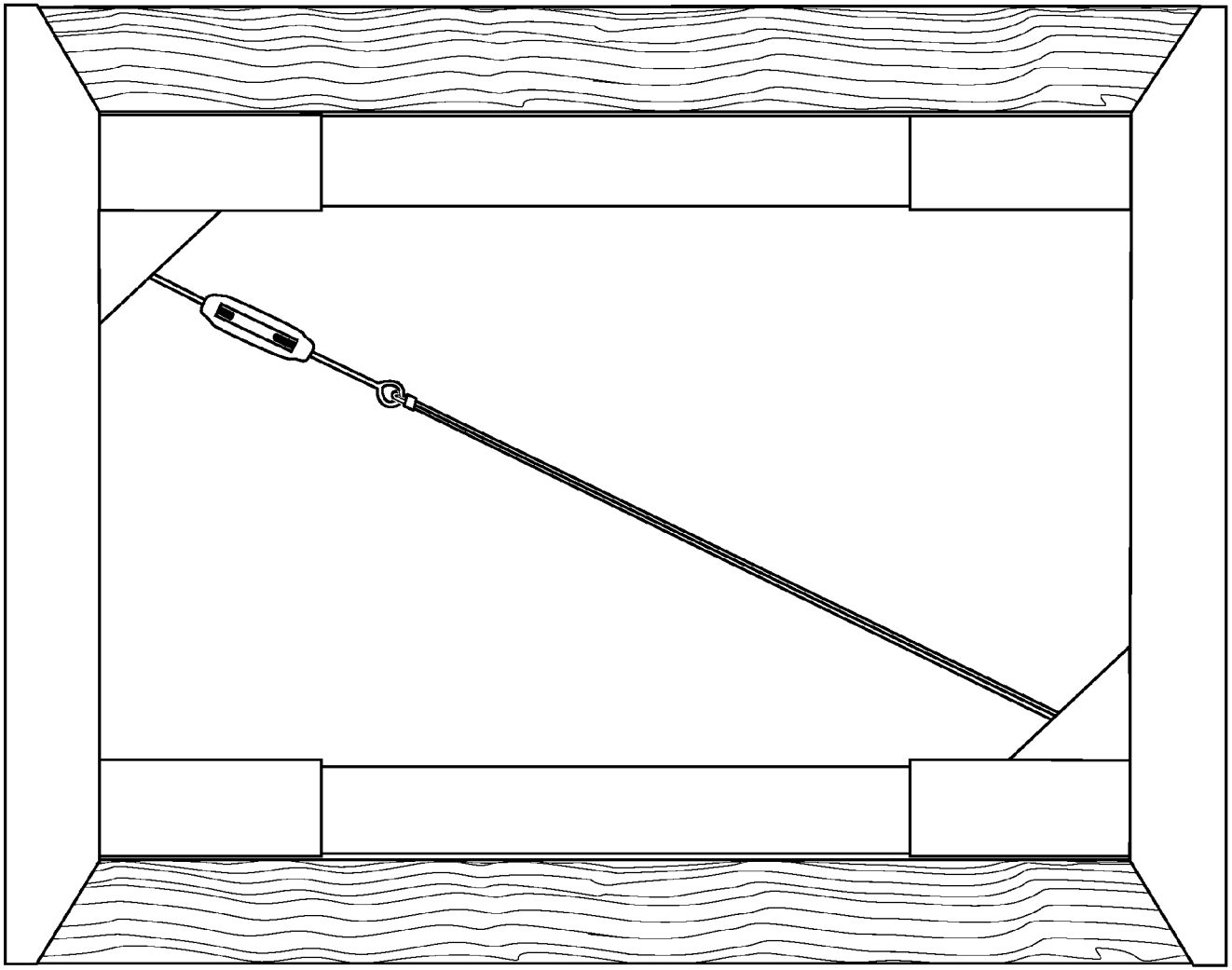
FIGS. 20, 21, and 22 illustrate front views of variations of the unique adjustable guttering anti-warping anti-sagging safety-truss gate.
Figure 21:
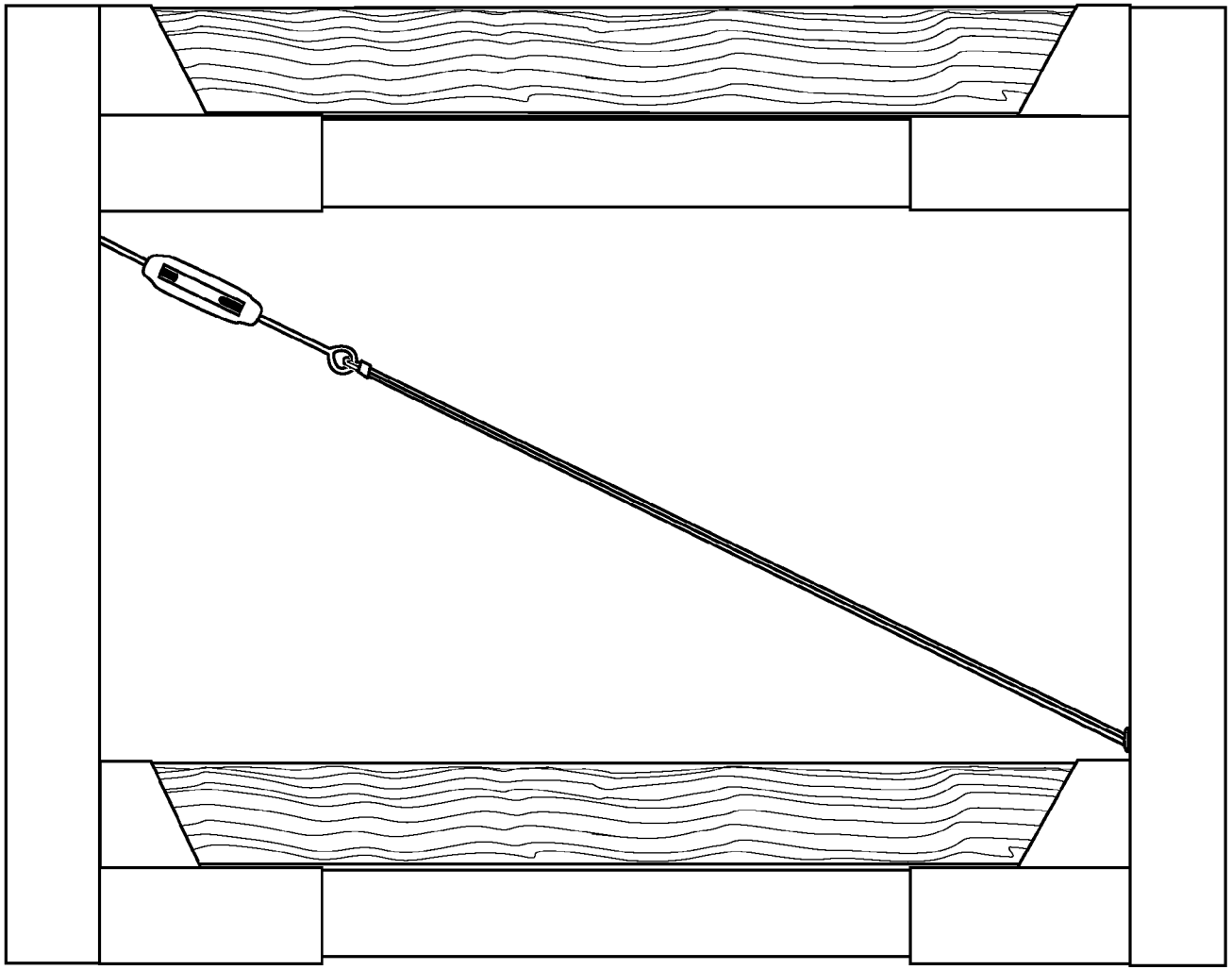
Figure 22:
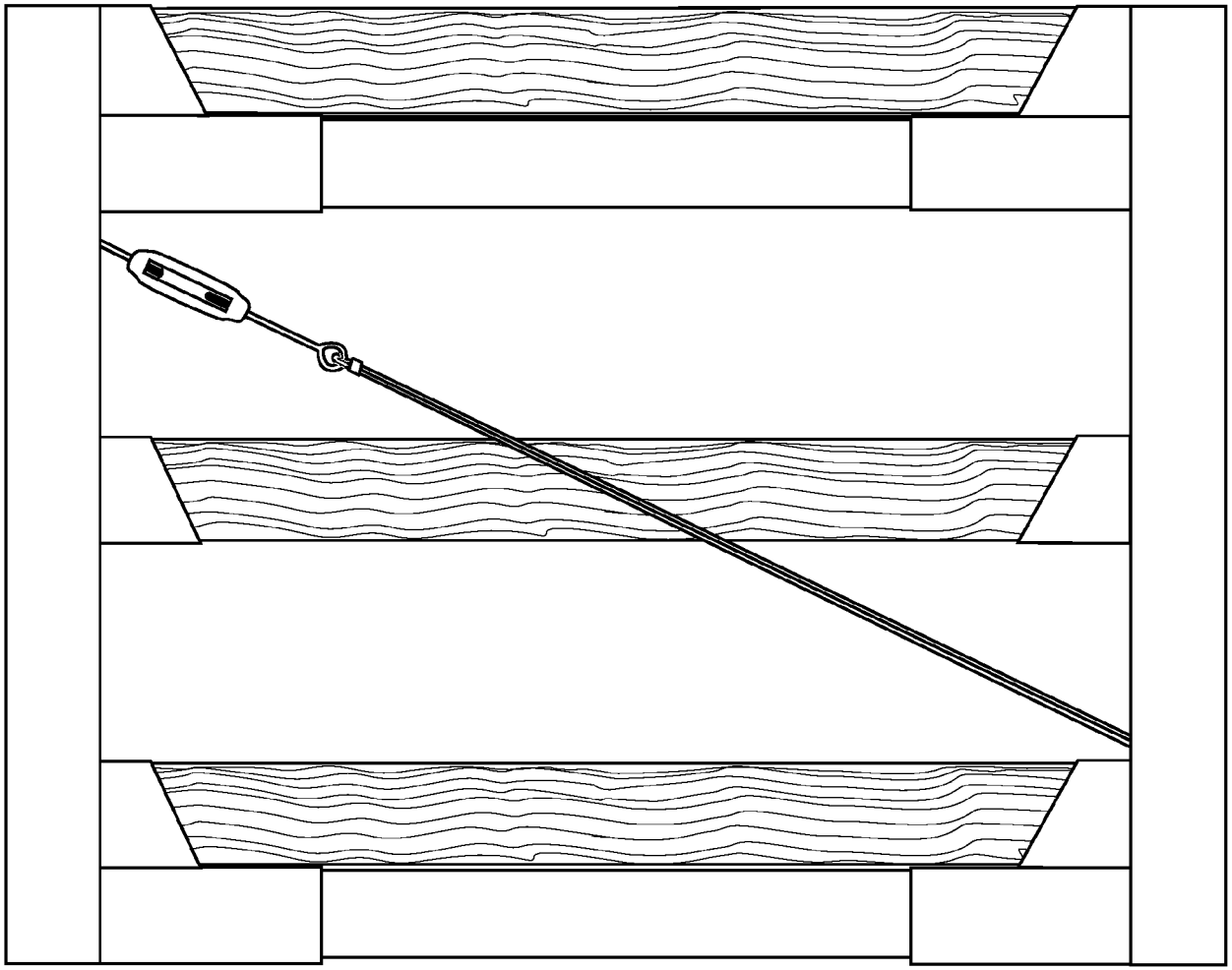

Referring to FIGS. 17, 18, 19, 20, 21, and 22:

FIG. 17 illustrates an equivalent of corner-gutter 50, 51, 52, or 53. An equivalent of corner-gutter drain hole 54, 55, 56, or 57 can be disposed at the bottom or side of the equivalent. Any one of corner-gutter drain holes 54, 55, 56, and 57 can have any shape and size. Any drain hole of drain-hole systems 74, 75, 76, 77, 78, 79, 80, and 81 can have any shape and size. Any one of horizontal-strut tunnels 60, 61, and extension-tube tunnels 70, 71 can have any shape and size. Any one of corner-gutters 50, 51, 52, and 53 can be screwed to respective vertical tube 72 or 73. FIG. 18 illustrates a side view of an equivalent of upper ridged tunneled extension tube 66. An equivalent of body-gutter 62, 63, 64, or 65 can have a similar shape, as illustrated in FIG. 18. FIG. 19 illustrates an equivalent 121 or 122 of impact-absorbing anti-warping spring 84, 85, 86, or 87. The equivalent can have a curved or straight, rectangular, or square shape, or any shape. FIG. 20 illustrates an equivalent of the unique adjustable guttering-system anti-warping anti-sagging safety-truss gate (FIG. 16). The top and bottom ends of left and right vertical tubes of the equivalent are diagonally cut to convert them into corner gutters to lead trapped rain water down the left and right vertical tubes and to secure the upper and lower tunneled horizontal struts of the equivalent. In addition, the equivalent can comprise at least one letter-L-shaped corner plate. FIG. 21 illustrates another equivalent of the unique adjustable guttering-system anti-warping anti-sagging safety-truss gate (FIG. 16). Any component of the unique adjustable guttering-system anti-warping anti-sagging safety-truss gate can have a cross-section of any shape and size. For example, vertical tube 72 or 73 can have a square, rectangular, or round cross-section. FIG. 22 illustrates another equivalent of the unique adjustable guttering-system anti-warping anti-sagging safety-truss gate (FIG. 16). The equivalent can comprise multiple corner-gutters, multiple tunneled horizontal struts, multiple body-gutters, and multiple ridged tunneled extension tubes.

MAJOR UNIQUE ADVANTAGES OF THE INVENTION

Referring to FIGS. 3A, 3B, 4, 5, 6, 8, 9, 10, and 11, the unique adjustable guttering anti-warping anti-sagging safety-truss gate has:

a) Multiple guttering systems,
b) Multiple impact-absorbing systems,
c) Multiple anti-warping systems,
d) Multiple anti-sagging systems,
e) Multiple personal-injury-eliminating systems, and
f) Self-centering angle-locking safety truss.

Therefore, the unique adjustable guttering anti-warping anti-sagging safety-truss gate provides the following unique benefits:

1) Upper and lower corner-gutters 50, 51, 52, and 53 are for:
   a) Discharging rain water 43*a*, 43*b*, 43*c*, and 43*d* trapped inside upper and lower corner-gutters 50, 51, 52, and 53,
      to prevent them from rusting, growing mold, and causing personal injuries and health issues for those, who clean, work on, and operate the unique gate
      (FIGS. 2 (PRIOR ART), 10, and 11); and
   b) Discharging rain water 43*a*, 43*b*, 43*c*, and 43*d* trapped under upper and lower horizontal struts 58 and 59,
      to prevent them from rotting, growing mold, and causing personal injuries and health issues for those, who clean, work on, and operate the unique gate
      (FIGS. 2 (PRIOR ART), 10, and 11).
2) First, second, third, fourth drain-hole systems 74, 75, 76, and 77 are for:
   a) Discharging rain water 43*a*, 43*b*, 43*c*, and 43*d* trapped inside upper and lower corner-gutters 50, 51, 52, and 53 to the ground,
      to prevent them from rusting, growing mold, and causing personal injuries and health issues for those, who clean, work on, and operate the unique gate
      (FIGS. 2 (PRIOR ART), 10, and 11); and
   b) Discharging rain water 43*a*, 43*b*, 43*c*, and 43*d* trapped under upper and lower horizontal struts 58 and 59 to the ground,
      to prevent them from rotting, growing mold, and causing personal injuries and health issues for those, who clean, work on, and operate the unique gate
      (FIGS. 2 (PRIOR ART), 10, and 11).
3) Upper and lower body-gutters 62, 63, 64, and 65 are for:
   a) Discharging rain water 38*a*, 38*b*, 38*c*, and 38*d* trapped inside upper and lower body-gutters 62, 63, 64, and 65,
      to prevent them from rusting, growing mold, and causing personal injuries and health issues for those, who clean, work on, and operate the unique gate
      (FIGS. 1 (PRIOR ART), 10, and 11); and b) Discharging rain water 38*a*, 38*b*, 38*c*, and 38*d* trapped inside upper and lower ridged tunneled extension tube 66 and 67, to prevent them from rusting, growing mold, and causing personal injuries and health issues for those, who clean, work on, and operate the unique gate (FIGS. 1 (PRIOR ART), 10, and 11).

4) Fifth, sixth, seventh, eighth drain-hole systems 78, 79, 80, and 81 are for:

a) Discharging rain water 38*a*, 38*b*, 38*c*, and 38*d* trapped inside upper and lower body-gutters 62, 63, 64, and 65 to the ground, to prevent them from rusting, growing mold, and causing personal injuries and health issues for those, who clean, work on, and operate the unique gate (FIGS. 1 (PRIOR ART), 10, and 11); and b) Discharging rain water 38*a*, 38*b*, 38*c*, and 38*d* trapped inside upper and lower ridged tunneled extension tube 66 and 67 to the ground, to prevent them from rusting, growing mold, and causing personal injuries and health issues for those, who clean, work on, and operate the unique gate (FIGS. 1 (PRIOR ART), 10, and 11).

5) Upper and lower impact-absorbing anti-warping springs 84, 85, 86, and 87 are for:

a) Absorbing the slamming forces exerted on the unique adjustable guttering anti-warping anti-sagging safety-truss gate during its lifespan, to prevent the unique gate from twisting and warping, which extends its lifespan (FIGS. 3A, 12, and 13); and b) Absorbing the warping forces exerted on the unique adjustable guttering anti-warping anti-sagging safety-truss gate during its lifespan, to prevent the unique gate from twisting and warping, which extends its lifespan (FIGS. 3A, 12, and 13).

6) Upper and lower ridged tunneled extension tubes 66 and 67 are for:

a) Generating counteracting forces 120*a* (FIG. 14), which counteract gravitational forces 46*a* and 46*b* exerted on the unique adjustable guttering anti-warping anti-sagging safety-truss gate during its lifespan, to prevent the unique gate from bending and sagging, which extends its lifespan (FIG. 2 (PRIOR ART); and b) Generating counteracting forces 120*b* (FIG. 14), which counteract gravitational forces 46*a* and 46*b* exerted on the unique adjustable guttering anti-warping anti-sagging safety-truss gate during its lifespan, to prevent the unique gate from bending and sagging, which extends its lifespan (FIG. 2 (PRIOR ART).

7) Personal-injury-eliminating systems are for (hiding all of exposed, rusting, and hazardous screw heads, to make the unique gate smooth, attractive, and safe (free of exposed, rusting, and hazardous screw heads)

(FIGS. 16, 21, and 22):

a) Hiding all exposed, rusting, and hazardous corner-gutter screw heads 91 of upper and lower corner-gutters 50, 51, 52, and 53 inside multiple screw-head-hiding dimples 90 in the back of upper and lower corner-gutters 50, 51, 52, and 53, to prevent them from scratching, poking, cutting, and causing personal injuries and health issues for those, who clean, work on, and operate the unique gate (FIGS. 16, 21, and 22); and b) Hiding all exposed, rusting, and hazardous extension-tube screw heads 92 of upper and lower ridged tunneled extension tubes 66 and 67 inside multiple lower-horizontal-strut tunnels 61 and multiple upper-extension-tube tunnels 70, to prevent them from scratching, poking, cutting, and causing personal injuries and health issues for those, who clean, work on, and operate the unique gate (FIGS. 16, 21, and 22).

8) Safety truss 93 are for (hiding both of its exposed, rusting, and hazardous truss-cable ends and clamp, to make the unique gate smooth, attractive, and safe (free of exposed, rusting, and hazardous truss-cable ends and clamp)

(FIGS. 11, 14, 15, 16, 21, and 22):

a) Hiding its self-centering angle-locking truss-cable-end clamp 100*e* inside right vertical tube 73 of the unique adjustable guttering anti-warping anti-sagging safety-truss gate during its lifespan, to prevent its self-centering angle-locking truss-cable-end clamp 100*e* from scratching, poking, cutting, and causing personal injuries and health issues for those, who clean, work on, and operate the unique gate (FIGS. 11, 14, 15, 16, 21, and 22); and b) Hiding both of its rusting hazardous first and second truss-cable ends 98 and 99 inside right vertical tube 73 of the unique adjustable guttering anti-warping anti-sagging safety-truss gate during its lifespan, to prevent both of its rusting hazardous first and second truss-cable ends 98 and 99 from scratching, poking, cutting, and causing personal injuries and health issues for those, who clean, work on, and operate the unique gate (FIGS. 11, 14, 15, 16, 21, and 22).

9) Multiple upper- and lower-extension-tube ridges 68 and 69 are for:

a) Absorbing the slamming forces exerted on the unique adjustable guttering anti-warping anti-sagging safety-truss gate during its lifespan, to prevent the unique gate from twisting and warping, which extends its lifespan (FIGS. 3A, 8, and 9);

b) Absorbing the warping forces exerted on the unique adjustable guttering anti-warping anti-sagging safety-truss gate during its lifespan, to prevent the unique gate from twisting and warping, which extends its lifespan (FIGS. 3A, 8, and 9);

c) Further, resisting bending, sagging, twisting, and turning, thereby retaining their original shape;

d) Further, resisting bending, sagging, twisting, and turning, thereby retaining their alignment with the fence;

e) Further, resisting bending, sagging, twisting, and turning, thereby retaining their original attractive appearance;

f) Further, resisting bending, sagging, twisting, and turning, thereby extending their lifespan; and Being more cost-effective, due to their longer lifespan.

10) Multiple upper- and lower-extension-tube ridges 68 and 69 are for:

a) Generating counteracting forces 120*a* (FIG. 14), which counteract gravitational forces 46*a* and 46*b* exerted on the unique adjustable guttering anti-warping anti-sagging safety-truss gate during its lifespan, to prevent the unique gate from bending and sagging, which extends its lifespan (FIG. 2 (PRIOR ART);

b) Generating counteracting forces 120*b* (FIG. 14), which counteract gravitational forces 46*a* and 46*b* exerted on the unique adjustable guttering anti-warping anti-sagging safety-truss gate during its lifespan, to prevent the unique gate from bending and sagging, which extends its lifespan (FIG. 2 (PRIOR ART);

c) Further, resisting bending, sagging, twisting, and turning, thereby retaining their original shape;

d) Further, resisting bending, sagging, twisting, and turning, thereby retaining their alignment with the fence;

e) Further, resisting bending, sagging, twisting, and turning, thereby retaining their original attractive appearance;

f) Further, resisting bending, sagging, twisting, and turning, thereby extending their lifespan; and Being more cost-effective, due to their longer lifespan.

11) Upper and lower impact-absorbing anti-warping springs 84, 85, 86, and 87 are for:

Therefore, the unique adjustable guttering anti-warping anti-sagging safety-truss gate:

a) Generating stabilizing spring forces 117*a*, 117*b*, 118*a*, 118*b*, 119*a*, and 119*b* (FIG. 13), which counteract impacting and warping forces exerted on vertical tubes 72 and 73, to prevent vertical tubes 72 and 73 from bending, sagging, twisting and turning, which shortens their lifespan;

b) Generating stabilizing spring forces 117*a*, 117*b*, 118*a*, 118*b*, 119*a*, and 119*b* (FIG. 13), which counteract twisting and turning forces exerted on vertical tubes 72 and 73, to prevent vertical tubes 72 and 73 from bending, sagging, twisting and turning, which shortens their lifespan;

c) Even further, resisting bending, sagging, twisting, and turning, thereby retaining their original shape;

d) Even further, resisting bending, sagging, twisting, and turning, thereby retaining their alignment with the fence;

e) Even further, resisting bending, sagging, twisting, and turning, thereby retaining their original attractive appearance;

f) Even further, resisting bending, sagging, twisting, and turning, thereby extending their lifespan; and g) Being even more cost-effective, due to their longer lifespan.

12) Upper and lower impact-absorbing anti-warping springs 84, 85, 86, and 87 are for:

a) Generating strengthening spring forces 117*a*, 117*b*, 118*a*, 118*b*, 119*a*, and 119*b* (FIG. 13), which counteract impacting and warping forces exerted on vertical tubes 72 and 73, to add more strength to vertical tubes 72 and 73 to prevent them from bending, sagging, twisting and turning, which shortens their lifespan;

b) Generating strengthening spring forces 117*a*, 117*b*, 118*a*, 118*b*, 119*a*, and 119*b* (FIG. 13), which counteract twisting and turning forces exerted on vertical tubes 72 and 73, to add more strength to vertical tubes 72 and 73 to prevent them from bending, sagging, twisting and turning, which shortens their lifespan;

c) Even further, resisting bending, sagging, twisting, and turning, thereby retaining their original shape;

d) Even further, resisting bending, sagging, twisting, and turning, thereby retaining their alignment with the fence;

e) Even further, resisting bending, sagging, twisting, and turning, thereby retaining their original attractive appearance;

f) Even further, resisting bending, sagging, twisting, and turning, thereby extending their lifespan; and g) Being even more cost-effective, due to their longer lifespan.

What is claimed is:

1. An adjustable gate, for discharging rain water, absorbing impact, warping, twisting, sagging forces, and eliminating injuries, comprising:

a plurality of corner gutters,
a plurality of corner-gutter drain holes,
a plurality of tunneled horizontal struts,
a plurality of horizontal-strut tunnels,
a plurality of body gutters,
a plurality of ridged tunneled extension tubes,
a plurality of extension-tube ridges,
a plurality of extension-tube tunnels,
a plurality of vertical tubes,
a plurality of first drain holes,
a plurality of second drain holes,
a plurality of third drain holes,
a plurality of fourth drain holes,
a plurality of fifth drain holes,
a plurality of sixth drain holes,
a plurality of seventh drain holes,
a plurality of eighth drain holes,
two truss holes,
first impact-absorbing anti-warping spring,
second impact-absorbing anti-warping spring,
third impact-absorbing anti-warping spring,
fourth impact-absorbing anti-warping spring
a plurality of screw-head-hiding dimples,
a plurality of corner-gutter screws,
a plurality of extension-tube screws,
a safety truss,
a turnbuckle hook,
a turnbuckle,
a cable hook,
a truss cable,
first truss-cable end,
second truss-cable end,
a self-centering angle-locking truss-cable-end clamp,
a self-centering head,
an angle-locking long wing,
an angle-locking short wing and
a plurality of clamp screws,
wherein,
said vertical tubes have
vertical-tube ends, respectively,
said corner-gutters are welded to
said body-gutters and
said vertical tubes at
said vertical-tube ends, respectively, said corner-gutter drain holes are cut or drilled into
said vertical tubes and communicate with
said corner-gutters, respectively,
said tunneled horizontal struts have
horizontal-strut ends, respectively,
said horizontal struts are inserted into
said corner-gutters at
said horizontal-strut ends, respectively,
said horizontal-strut tunnels have
horizontal-strut bottoms, respectively,
said horizontal-strut tunnels are cut into and along
said horizontal-strut bottoms, respectively,
said body-gutters are welded to
said corner-gutters and
said vertical tubes at
said opposite vertical-tube ends, respectively,
said ridged tunneled extension tube are inserted into
said body-gutters, respectively,
said extension-tube ridges have
extension-tube bottoms, respectively,
said extension-tube ridges are formed into and along
said extension-tube bottoms, respectively,
said extension-tube tunnels are formed into and along
said extension-tube bottoms, respectively,
said first, second, third, and fourth drain holes are drilled into
said vertical tubes and communicate with
said corner-gutters, respectively,
said fifth, sixth, seventh, eighth drain holes are drilled into
said vertical tubes and communicate with
said body gutters,
said truss holes are drilled into
said vertical tubes, respectively,
said vertical tubes have
vertical-tube inner surfaces, respectively,
said first, second, third, and fourth impact-absorbing anti-warping springs
are diagonally welded to
said vertical-tube inner surfaces, respectively,
said corner gutters have
corner-gutter rear surfaces, respectively,
said screw-head-hiding dimples are formed into
said corner-gutter rear surface, respectively,
said corner-gutter screws have
corner-gutter screw heads, respectively,
said corner-gutter screws are screwed into
said screw-head-hiding dimples and into
said horizontal-strut ends
to hide said corner-gutter screw heads inside
said screw-head-hiding dimples, respectively,
to give said adjustable gate a screw-head-free appearance,
said extension-tube screws have
extension-tube screw heads, respectively,
said extension-tube screws are screwed into
said ridged tunneled extension tubes and into
said tunneled horizontal struts
to hide said extension-tube screw heads inside
said extension-tube tunnels and inside
said horizontal-strut tunnels, respectively,
to give said adjustable gate a screw-head-free appearance,
said turnbuckle hook is hooked into
one of said two truss holes,
said cable hook is screwed in
said turnbuckle,
said truss cable is threaded through
said cable hook,
said first and second truss-cable ends are inserted into
another one of said two truss holes,
said self-centering angle-locking truss-cable-end clamp clamps on
said first and second truss-cable ends,
said self-centering head is molded to
said self-centering angle-locking truss-cable-end clamp,
said self-centering angle-locking truss-cable-end clamp has
two opposite clamp corners,
said angle-locking long and short wings are molded to
said clamp corners, and
said clamp screws are screwed on
said self-centering angle-locking truss-cable-end clamp,
wherein,
said corner gutters are for
leading rain water trapped between
said ridged tunneled extension tubes and
said tunneled horizontal struts to
said first, second, third, and fourth drain holes, respectively,
leading rain water trapped between
said tunneled horizontal struts and
said corner gutters to
said first, second, third, and fourth drain holes, respectively,
discharging rain water trapped between
said ridged tunneled extension tubes and
said tunneled horizontal struts through
said first, second, third, and fourth drain holes, respectively, and
discharging rain water trapped between
said tunneled horizontal struts and
said corner gutters through
said first, second, third, and fourth drain holes, respectively,
said corner-gutter drain holes are for
draining trapped rain water from
said ridged tunneled extension tubes into
said first, second, third, and fourth drain-holes, respectively,
draining trapped rain water from
said tunneled horizontal struts into
said first, second, third, and fourth drain-holes, respectively, and
draining trapped rain water from said corner gutters into
said first, second, third, and fourth drain-holes, respectively,
said horizontal-strut tunnels are for
leading trapped rain water away from
said ridged tunneled extension tubes to
said first, second, third, and fourth drain-holes, respectively,
leading trapped rain water away from
said tunneled horizontal struts to
said first, second, third, and fourth drain-holes, respectively, and
leading trapped rain water away from
said corner gutters to
said first, second, third, and fourth drain-holes, respectively,
said body gutters are for:
leading rain water trapped between said tunneled horizontal struts and
said ridged tunneled extension tubes to
said fifth, sixth, seventh, and eighth drain holes, respectively,
leading rain water trapped between said ridged tunneled extension tubes and
said body gutters to
said fifth, sixth, seventh, and eighth drain holes, respectively,
discharging rain water trapped between said tunneled horizontal struts and
said ridged tunneled extension tubes through
said fifth, sixth, seventh, and eighth drain holes, respectively, and
discharging rain water trapped between said ridged tunneled extension tubes and
said body gutters through
said fifth, sixth, seventh, and eighth drain holes, respectively,
said ridged tunneled extension tubes are for
adjusting the width of said adjustable gate,
said tunneled horizontal struts are for
adjusting the width of said adjustable gate,
said extension-tube ridges are for
strengthening said ridged tunneled extension tubes, respectively,
said extension-tube tunnels are for
leading trapped rain water away from
said ridged tunneled extension tubes to
said fifth, sixth, seventh, and eighth drain holes, respectively,
leading trapped rain water away from
said tunneled horizontal struts to
said fifth, sixth, seventh, and eighth drain holes, respectively, and
leading trapped rain water away from
said body gutters to
said fifth, sixth, seventh, and eighth drain holes, respectively,
said vertical tubes are for:
draining trapped rain water from
said corner gutters
down to the ground, respectively,
draining trapped rain water from
said body gutters
down to the ground, respectively,
draining trapped rain water from
said ridged tunneled extension tubes
down to the ground, respectively,
draining trapped rain water from
said tunneled horizontal struts
down to the ground, respectively,
draining trapped rain water from
said first, second, third, and fourth drain-holes,
down to the ground, respectively, and
draining trapped rain water from
said fifth, sixth, seventh, and eighth drain holes,
down to the ground, respectively,
said first, second, third, and fourth drain holes are for
draining trapped rain water from said corner gutters
into said vertical tubes and
down to the ground, respectively,
draining trapped rain water from said ridged tunneled extension tubes
into said vertical tubes and
down to the ground, respectively, and
draining trapped rain water from said tunneled horizontal struts
into said vertical tubes and
down to the ground, respectively,
said fifth, sixth, seventh, and eighth drain holes are for
draining trapped rain water from
said body gutters into
said vertical tubes and
down to the ground, respectively,
draining trapped rain water from
said ridged tunneled extension tubes into
said vertical tubes and
down to the ground, respectively, and
draining trapped rain water from
said tunneled horizontal struts into
said vertical tubes and
down to the ground, respectively,
said first, second, third, and fourth impact-absorbing anti-warping springs are for
absorbing bending force exerted on said vertical tubes, and said adjustable gate, respectively,
absorbing sagging force exerted on said vertical tubes, and aid adjustable gate, respectively,
resisting impacting force exerted on said vertical tubes, and said adjustable gate, respectively,
resisting warping force exerted on said vertical tubes, and said adjustable gate, respectfully,
resisting twisting force exerted on said vertical tubes, and said adjustable gate, respectfully,
resisting bending force exerted on said vertical tubes, and said adjustable gate, respectfully,
resisting gravitational force exerted on said vertical tubes,
and said adjustable gate, respectfully,
said corner-gutter screws are for
securing said tunneled horizontal struts to
said corner-gutters, respectively,
said extension-tube screws are for
securing said ridged tunneled extension tubes to
said tunneled horizontal struts, respectively, and
securing said ridged tunneled extension tubes to
said body-gutters, respectively,
said screw-head-hiding dimples are for
hiding said corner-gutter screw heads therein, respectively,
to give said adjustable gate a screw-head-free appearance,
said extension-tube tunnels are for
hiding said extension-tube screw heads therein, respectively,
to give said adjustable gate a screw-head-free appearance,
said horizontal-strut tunnels are for
hiding said extension-tube screw heads therein, respectively,
to give said adjustable gate a screw-head-free appearance,
said safety truss is for
maintaining an original shape of said adjustable gate,
said turnbuckle is for
adjusting the tension of said safety truss,
said self-centering angle-locking truss-cable-end clamp is for
locking said first and second truss-cable ends
inside one of said vertical tubes
to prevent said first and second truss-cable ends from cutting, scratching, poking, and causing injuries to people,
locking said first and second truss-cable ends inside one of said vertical tubes,
to protect said first and second truss-cable ends from weather elements, and
locking said first and second truss-cable ends in an angle inside one of said vertical tubes,
to easily tension said first and second truss-cable ends,
said self-centering head is for
being inserted in one of said two truss holes
to center said self-centering angle-locking truss-cable-end clamp
in one of said vertical tubes when said safety truss is tensioned,
said angle-locking long wing is for
locking said self-centering angle-locking truss-cable-end clamp
in an angle inside one of said vertical tubes
when said safety truss is tensioned
to easily tension said first and second truss-cable ends, and
locking said first and second truss-cable ends in an angle inside one of said vertical tubes
to easily tension said first and second truss-cable ends,
said angle-locking short wing is for
locking said self-centering angle-locking truss-cable-end clamp
in an angle inside one of said vertical tubes
to easily tension said first and second truss-cable ends, and
locking said first and second truss-cable ends
in an angle inside one of said vertical tubes
to easily tension said first and second truss-cable ends, and
said clamp screws are for
screwing said self-centering angle-locking truss-cable-end clamp on
said first and second truss-cable ends
to lock said first and second truss-cable ends
in an angle inside one of said vertical tubes.

2. The adjustable gate of claim 1, wherein, said first, second, third, and fourth impact-absorbing anti-warping springs each have a letter-W-shaped cross-section.

3. The adjustable gate of claim 1, wherein, said corner gutters and said body gutters each have a cup shape.

4. The adjustable gate of claim 1, wherein, said horizontal-strut tunnels each have a half-moon shape.

5. The adjustable gate of claim 1, wherein, said extension-tube tunnels each have a half-moon shape.

6. The adjustable gate of claim 1, wherein, said first, second, third, fourth, fifth, sixth, seventh, and eighth drain holes each have a shape selected from the group consisting of: a round shape, square shape, a rectangular shape, and an oval shape.

7. The adjustable gate of claim 1, wherein, said corner gutters, said body gutters, said ridged tunneled extension tubes and said vertical tubes each have a cross-section selected from the group consisting of: round cross-section, square cross-section, rectangular cross-section, and oval cross-section.

8. The adjustable gate of claim 1, wherein, said self-centering head, said angle-locking long wing, and said angle-locking short wing are molded to said self-centering angle-locking truss-cable-end clamp, in an angle.

9. The adjustable gate of claim 1, wherein, said corner gutters comprise six gutters, and said tunneled horizontal struts comprise three struts.

10. The adjustable gate of claim 1, further, comprising gate boards and gate-board screws, said gate-board screws for screwing said gate boards on said tunneled horizontal struts.

11. An adjustable gate, for discharging rain water, comprising:
a plurality of corner gutters,
a plurality of corner-gutter drain holes,
a plurality of tunneled struts,
a plurality of strut tunnels,
a plurality of body gutters,
a plurality of ridged tunneled extension tubes,
a plurality of extension-tube ridges,
a plurality of extension-tube tunnels,
a plurality of vertical tubes,
a plurality of first drain holes,
a plurality of second drain holes,
a plurality of third drain holes,
a plurality of fourth drain holes,
a plurality of fifth drain holes,
a plurality of sixth drain holes,
a plurality of seventh drain holes,
a plurality of eighth drain holes,
two truss holes,
first impact-absorbing anti-warping spring,
second impact-absorbing anti-warping spring,
third impact-absorbing anti-warping spring,
fourth impact-absorbing anti-warping spring,
a plurality of screw-head-hiding dimples,
a plurality of corner-gutter screws,
a plurality of extension-tube screws,
a safety truss,
a turnbuckle hook,
a turnbuckle,
a cable hook,
a truss cable,
first truss-cable end,
second truss-cable end,
a self-centering angle-locking clamp,
a self-centering head,
an angle-locking long wing,
an angle-locking short wing, and
a plurality of clamp screws,
wherein,
said vertical tubes have
vertical-tube ends, respectively,
said corner-gutters are welded to
said body-gutters and
said vertical tubes at
said vertical-tube ends, respectively,
said corner-gutter drain holes are cut or drilled into
said vertical tubes and communicate with
said corner-gutters, respectively,
said tunneled struts have
horizontal-strut ends, respectively,
said horizontal struts are inserted into
said corner-gutters at
said horizontal-strut ends, respectively,
said strut tunnels have
horizontal-strut bottoms, respectively,
said strut tunnels are cut into and along
said horizontal-strut bottoms, respectively,
said body-gutters are welded to
said corner-gutters and said vertical tubes at
said opposite vertical-tube ends, respectively,
said ridged tunneled extension tube are inserted into
said body-gutters, respectively,
said extension-tube ridges have
extension-tube bottoms, respectively,
said extension-tube ridges are formed into and along
said extension-tube bottoms, respectively,
said extension-tube tunnels are formed into and along
said extension-tube bottoms, respectively,
said first, second, third, and fourth drain holes are drilled into
said vertical tubes and communicate with
said corner-gutters, respectively,
said fifth, sixth, seventh, eighth drain holes are drilled into
said vertical tubes and communicate with
said body gutters,
said truss holes are drilled into
said vertical tubes, respectively,
said vertical tubes have
vertical-tube inner surfaces, respectively,
said first, second, third, and fourth impact-absorbing anti-warping springs
are diagonally welded to
said vertical-tube inner surfaces, respectively,
said corner gutters have
corner-gutter rear surfaces, respectively,
said screw-head-hiding dimples are formed into
said corner-gutter rear surface, respectively,
said corner-gutter screws have
corner-gutter screw heads, respectively,
said corner-gutter screws are screwed into
said screw-head-hiding dimples and into
said horizontal-strut ends
to hide said corner-gutter screw heads inside
said screw-head-hiding dimples, respectively,
to give said adjustable gate a screw-head-free appearance,
said extension-tube screws have
extension-tube screw heads, respectively,
said extension-tube screws are screwed into
said ridged tunneled extension tubes and into
said tunneled struts
to hide said extension-tube screw heads inside
said extension-tube tunnels and inside
said strut tunnels, respectively,
to give said adjustable gate a screw-head-free appearance,
said turnbuckle hook is hooked into
one of said two truss holes,
said cable hook is screwed in
said turnbuckle,
said truss cable is threaded through
said cable hook,
said first and second truss-cable ends are inserted into
another one of said two truss holes,
said self-centering angle-locking clamp clamps on
said first and second truss-cable ends,
said self-centering head is molded to
said self-centering angle-locking clamp,
said self-centering angle-locking clamp has
two opposite clamp corners,
said angle-locking long and short wings are molded to
said clamp corners, and
said clamp screws are screwed on
said self-centering angle-locking clamp,
wherein,
said corner gutters are for
leading rain water trapped between
said ridged tunneled extension tubes and
said tunneled struts to
said first, second, third, and fourth drain holes, respectively,
leading rain water trapped between
said tunneled struts and
said corner gutters to
said first, second, third, and fourth drain holes, respectively,
discharging rain water trapped between
said ridged tunneled extension tubes and
said tunneled struts through
said first, second, third, and fourth drain holes, respectively, and
discharging rain water trapped between
said tunneled struts and
said corner gutters through
said first, second, third, and fourth drain holes, respectively,
said corner-gutter drain holes are for
draining trapped rain water from
said ridged tunneled extension tubes into
said first, second, third, and fourth drain-holes, respectively,
draining trapped rain water from
said tunneled struts into
said first, second, third, and fourth drain-holes, respectively, and
draining trapped rain water from said corner gutters into
said first, second, third, and fourth drain-holes, respectively,
said strut tunnels are for
leading trapped rain water away from
said ridged tunneled extension tubes to
said first, second, third, and fourth drain-holes, respectively,
leading trapped rain water away from
said tunneled struts to
said first, second, third, and fourth drain-holes, respectively, and
leading trapped rain water away from
said corner gutters to
said first, second, third, and fourth drain-holes, respectively,
said body gutters are for:
leading rain water trapped between said tunneled struts and said
ridged tunneled extension tubes to
said fifth, sixth, seventh, and eighth drain holes, respectively,
leading rain water trapped between said ridged tunneled extension tubes and
said body gutters to
said fifth, sixth, seventh, and eighth drain holes, respectively,
discharging rain water trapped between said tunneled struts and
said ridged tunneled extension tubes through
said fifth, sixth, seventh, and eighth drain holes, respectively, and
discharging rain water trapped between said ridged tunneled extension tubes and
said body gutters through said fifth, sixth, seventh, and eighth drain holes, respectively,
said ridged tunneled extension tubes are for
adjusting the width of said adjustable gate,
said tunneled struts are for
adjusting the width of said adjustable gate,
said extension-tube ridges are for
strengthening said ridged tunneled extension tubes, respectively,
said extension-tube tunnels are for
leading trapped rain water away from said ridged tunneled extension tubes to
said fifth, sixth, seventh, and eighth drain holes, respectively,
leading trapped rain water away from said tunneled struts to
said fifth, sixth, seventh, and eighth drain holes, respectively, and
leading trapped rain water away from said body gutters to
said fifth, sixth, seventh, and eighth drain holes, respectively,
said vertical tubes are for:
draining trapped rain water from
said corner gutters
down to the ground, respectively,
draining trapped rain water from
said body gutters
down to the ground, respectively,
draining trapped rain water from
said ridged tunneled extension tubes
down to the ground, respectively,
draining trapped rain water from
said tunneled struts
down to the ground, respectively,
draining trapped rain water from
said first, second, third, and fourth drain-holes,
down to the ground, respectively, and
draining trapped rain water from
said fifth, sixth, seventh, and eighth drain holes,
down to the ground, respectively,
said first, second, third, and fourth drain holes are for
draining trapped rain water from
said corner gutters
into said vertical tubes and
down to the ground, respectively,
draining trapped rain water from
said ridged tunneled extension tubes
into said vertical tubes and
down to the ground, respectively, and
draining trapped rain water from
said tunneled struts
into said vertical tubes and
down to the ground, respectively,
said fifth, sixth, seventh, and eighth drain holes are for
draining trapped rain water from
said body gutters
into said vertical tubes and
down to the ground, respectively,
draining trapped rain water from
said ridged tunneled extension tubes
into said vertical tubes and
down to the ground, respectively, and
draining trapped rain water from
said tunneled struts
into said vertical tubes and
down to the ground, respectively,
said first, second, third, and fourth impact-absorbing anti-warping springs are for
absorbing impacting force exerted on said vertical tubes
and said adjustable gate, respectively,
absorbing warping force exerted on said vertical tubes, and said adjustable gate, respectively,
absorbing twisting force exerted on said vertical tubes, and said adjustable gate, respectively,
absorbing bending force exerted on said vertical tubes,
and said adjustable gate, respectively,
absorbing sagging force exerted on said vertical tubes,
and said adjustable gate, respectively,
resisting impacting force exerted on said vertical tubes,
and adjustable gate, respectively, d
resisting warping force exerted on said vertical tubes, and said adjustable gate, respectively,
resisting twisting force exerted on said vertical tubes, and said adjustable gate, respectively,
resisting bending force exerted on said vertical tubes, and said adjustable gate, respectively,
resisting gravitational force exerted on said vertical tubes,
and said adjustable gate, respectively,
said corner-gutter screws are for
securing said tunneled struts to
said corner-gutters, respectively,
said extension-tube screws are for
securing said ridged tunneled extension tubes to
said tunneled struts, respectively, and
securing said ridged tunneled extension tubes to
said body-gutters, respectively,
said screw-head-hiding dimples are for
hiding said corner-gutter screw heads therein, respectively,
to give said adjustable gate a screw-head-free appearance,
said extension-tube tunnels are for
hiding said extension-tube screw heads therein, respectively,
to give said adjustable gate a screw-head-free appearance,
said strut tunnels are for
hiding said extension-tube screw heads therein, respectively,
to give said adjustable gate a screw-head-free appearance,
said safety truss is for
maintaining an original shape of said adjustable gate,
said turnbuckle is for
adjusting the tension of said safety truss,
said self-centering angle-locking clamp is for
locking said first and second truss-cable ends
inside one of said vertical tubes
to prevent said first and second truss-cable ends
from cutting, scratching, poking, and causing injuries to people,
locking said first and second truss-cable ends
inside one of said vertical tubes,
to protect said first and second truss-cable ends
from weather elements, and
locking said first and second truss-cable ends
in an angle inside one of said vertical tubes, to easily tension said first and second truss-cable ends,
said self-centering head is for
being inserted in one of said two truss holes
to center said self-centering angle-locking clamp
in one of said vertical tubes when said safety truss is tensioned,
said angle-locking long wing is for
locking said self-centering angle-locking clamp
in an angle inside one of said vertical tubes
when said safety truss is tensioned
to easily tension said first and second truss-cable ends, and
locking said first and second truss-cable ends
in an angle inside one of said vertical tubes
to easily tension said first and second truss-cable ends,
said angle-locking short wing is for
locking said self-centering angle-locking clamp
in an angle inside one of said vertical tubes
to easily tension said first and second truss-cable ends, and
locking said first and second truss-cable ends
in an angle inside one of said vertical tubes
to easily tension said first and second truss-cable ends, and
said clamp screws are for
screwing said self-centering angle-locking clamp on said first and second truss-cable ends
to lock said first and second truss-cable ends
in an angle inside one of said vertical tubes.

12. The adjustable gate of claim 11, wherein, said first, second, third, and fourth impact-absorbing anti-warping springs each have a letter-W-shaped cross-section.

13. The adjustable gate of claim 11, wherein, said corner gutters and said body gutters each have a cup shape.

14. The adjustable gate of claim 11, wherein, said self-centering head, said angle-locking long wing, and said angle-locking short wing are molded to said self-centering angle-locking clamp, in an angle.

15. The adjustable gate of claim 11, further, comprising gate boards and gate-board screws, said gate-board screws for screwing said gate boards on said tunneled struts.

16. An adjustable gate comprising:
a plurality of corner gutters,
a plurality of corner-gutter drain holes,
a plurality of struts,
a plurality of body gutters,
a plurality of extension tubes,
a plurality of extension-tube ridges,
a plurality of extension-tube tunnels,
a plurality of vertical tubes,
a plurality of at least one vertical tube drain hole,
two truss holes,
a plurality of dimples,
a plurality of corner-gutter screws,
a plurality of extension-tube screws,
a safety truss,
a turnbuckle hook,
a turnbuckle,
a cable hook,
a truss cable,
first truss-cable end,
second truss-cable end,
a self-centering angle-locking clamp, and
a plurality of clamp screws,
wherein,
said vertical tubes have
vertical-tube ends, respectively,
said corner-gutters are welded to
said body-gutters and
said vertical tubes at
said vertical-tube ends, respectively,
said corner-gutter drain holes are cut or drilled into
said vertical tubes and communicate with
said corner-gutters, respectively,
said struts have
horizontal-strut ends, respectively,
said horizontal struts are inserted into
said corner-gutters at
said horizontal-strut ends, respectively,
said body-gutters are welded to
said corner-gutters and
said vertical tubes at
said opposite vertical-tube ends, respectively,
said ridged tunneled extension tube are inserted into
said body-gutters, respectively,
said extension-tube ridges have
extension-tube bottoms, respectively,
said extension-tube ridges are formed into and along
said extension-tube bottoms, respectively,
said extension-tube tunnels are formed into and along
said extension-tube bottoms, respectively,
said at least one vertical-tube drain hole is cut or drilled into
said vertical tubes, respectively,
said truss holes are cut or drilled into
said vertical tubes, respectively,
said corner gutters have
corner-gutter rear surfaces, respectively,
said dimples are formed into
said corner-gutter rear surface, respectively,
said corner-gutter screws have
corner-gutter screw heads, respectively,
said corner-gutter screws are screwed into
said dimples and into
said horizontal-strut ends
to hide said corner-gutter screw heads inside
said dimples, respectively,
to give said adjustable gate a screw-head-free appearance,
said extension-tube screws have
extension-tube screw heads, respectively,
said extension-tube screws are screwed into
said extension tubes and into
said struts
to hide said extension-tube screw heads inside
said extension-tube tunnels, respectively,
to give said adjustable gate a screw-head-free appearance,
said turnbuckle hook is hooked into
one of said two truss holes,
said cable hook is screwed in
said turnbuckle,
said truss cable is threaded through
said cable hook,
said first and second truss-cable ends are inserted into
another one of said two truss holes,
said self-centering angle-locking clamp clamps on
said first and second truss-cable ends,
said clamp screws are screwed on
said self-centering angle-locking clamp,
wherein,
said corner gutters are for leading rain water trapped between
said extension tubes and
said struts to
said at least one vertical-tube drain hole, respectively,
leading rain water trapped between
said struts and
said corner gutters to
said at least one vertical-tube drain hole, respectively,
discharging rain water trapped between
said extension tubes and
said struts through
said at least one vertical-tube drain hole, respectively, and
discharging rain water trapped between
said struts and
said corner gutters through
said at least one vertical-tube drain hole, respectively,
said corner-gutter drain holes are for
draining trapped rain water from
said extension tubes into
said at least one vertical-tube drain hole, respectively,
draining trapped rain water from
said struts into
said at least one vertical-tube drain hole, respectively, and
draining trapped rain water from said corner gutters into
said at least one vertical-tube drain hole, respectively,
said body gutters are for:
leading rain water trapped between
said struts and
said extension tubes to
said at least one vertical-tube drain hole, respectively,
leading rain water trapped between
said extension tubes and
said body gutters to
said at least one vertical-tube drain hole, respectively,
discharging rain water trapped between
said struts and
said extension tubes through
said at least one vertical-tube drain hole, respectively, and
discharging rain water trapped between
said extension tubes and
said body gutters through
said at least one vertical-tube drain hole, respectively,
said extension tubes are for
adjusting the width of said adjustable gate,
said struts are for
adjusting the width of said adjustable gate,
said extension-tube ridges are for
strengthening said extension tubes, respectively,
said extension-tube tunnels are for
leading trapped rain water away from said extension tubes to
said at least one vertical-tube drain hole, respectively,
leading trapped rain water away from said struts to
said at least one vertical-tube drain hole, respectively, and
leading trapped rain water away from said body gutters to
said at least one vertical-tube drain hole, respectively,
said vertical tubes are for:
draining trapped rain water from
said corner gutters
down to the ground, respectively,
draining trapped rain water from
said body gutters
down to the ground, respectively,
draining trapped rain water from
said extension tubes
down to the ground, respectively,
draining trapped rain water from
said struts
down to the ground, respectively,
draining trapped rain water from
said at least one vertical-tube drain hole,
down to the ground, respectively, and
draining trapped rain water from
said at least one vertical-tube drain hole,
down to the ground, respectively,
said at least one vertical-tube drain hole is for
draining trapped rain water from
said corner gutters
into said vertical tubes and
down to the ground, respectively,
draining trapped rain water from
said extension tubes
into said vertical tubes and
down to the ground, respectively, and
draining trapped rain water from said struts
into said vertical tubes and
down to the ground, respectively,
draining trapped rain water from
said body gutters
into said vertical tubes and
down to the ground, respectively,
said corner-gutter screws are for
securing said struts to
said corner-gutters, respectively,
said extension-tube screws are for
securing said extension tubes to
said struts, respectively, and
securing said extension tubes to
said body-gutters, respectively,
said dimples are for
hiding said corner-gutter screw heads therein, respectively,
to give said adjustable gate a screw-head-free appearance,
said extension-tube tunnels are for
hiding said extension-tube screw heads therein, respectively,
to give said adjustable gate a screw-head-free appearance,
said safety truss is for
maintaining an original shape of said adjustable gate,
said turnbuckle is for adjusting the tension of
said safety truss,
said self-centering angle-locking clamp is for
locking said first and second truss-cable ends
inside one of said vertical tubes
to prevent said first and second truss-cable ends
from cutting, scratching, poking, and causing injuries to people,
locking said first and second truss-cable ends
inside one of said vertical tubes,
to protect said first and second truss-cable ends from weather elements, and locking said first and second truss-cable ends in an angle inside one of said vertical tubes, to easily tension said first and second truss-cable ends, and said clamp screws are for screwing said self-centering angle-locking clamp on said first and second truss-cable ends to lock said first and second truss-cable ends in an angle inside one of said vertical tubes.

17. The adjustable gate of claim 16, wherein, said corner gutters and said body gutters each have a cup shape.

18. The adjustable gate of claim 16, wherein, said corner gutters comprise six corner gutters, wherein said struts comprise three struts.

19. The adjustable gate of claim 16, wherein, said corner gutters, said body gutters, said extension tubes and said vertical tubes each have a cross-section selected from the group consisting of: round cross-section, square cross-section, rectangular cross-section, and oval cross-section.

20. The adjustable gate of claim 16, further, comprising gate boards and gate-board screws, said gate-board screws for screwing said gate boards on said struts.

* * * * *